US008381544B2

(12) United States Patent
Coyle

(10) Patent No.: US 8,381,544 B2
(45) Date of Patent: Feb. 26, 2013

(54) METHOD FOR LIQUEFACTION OF NATURAL GAS

(75) Inventor: David A. Coyle, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1254 days.

(21) Appl. No.: 12/175,559

(22) Filed: Jul. 18, 2008

(65) Prior Publication Data

US 2010/0011663 A1 Jan. 21, 2010

(51) Int. Cl.
*F25J 3/00* (2006.01)
*F17C 7/02* (2006.01)
*C01B 3/32* (2006.01)

(52) U.S. Cl. ..... 62/618; 62/50.1; 62/50.2; 62/620; 48/127.1; 48/127.3; 137/6

(58) Field of Classification Search ..... 62/50.1, 62/50.2, 618, 620; 48/127.1, 127.3
See application file for complete search history.

(56) References Cited

U.S. PATENT DOCUMENTS

| | | | | |
|---|---|---|---|---|
| 2,815,650 | A | 12/1957 | McIntire et al. | |
| 2,952,984 | A | 9/1960 | Marshall et al. | |
| 3,405,530 | A | 10/1968 | Denahan et al. | |
| 3,407,052 | A * | 10/1968 | Huntress et al. | 48/127.3 |
| 3,420,068 | A | 1/1969 | Petit et al. | |
| 3,446,029 | A | 5/1969 | Grgurich et al. | |
| 3,570,261 | A | 3/1971 | Schwartzman | |
| 3,656,312 | A | 4/1972 | Streich | |
| 3,760,597 | A * | 9/1973 | Becker | 62/48.2 |
| 3,837,172 | A | 9/1974 | Markbreiter et al. | |
| 4,009,097 | A | 2/1977 | Ward | |
| 4,479,871 | A | 10/1984 | Pahade et al. | |
| 5,114,451 | A | 5/1992 | Rambo et al. | |
| 5,755,115 | A | 5/1998 | Manley | |
| 5,950,453 | A | 9/1999 | Bowen et al. | |
| 5,953,935 | A | 9/1999 | Sorensen | |
| 5,956,971 | A | 9/1999 | Cole et al. | |
| 6,016,665 | A | 1/2000 | Cole et al. | |
| 6,023,942 | A | 2/2000 | Thomas et al. | |
| 6,182,469 | B1 | 2/2001 | Campbell et al. | |
| 6,237,364 | B1 | 5/2001 | Stone | |
| 6,510,706 | B2 | 1/2003 | Stone et al. | |
| 6,564,579 | B1 | 5/2003 | McCartney | |

(Continued)

FOREIGN PATENT DOCUMENTS

| | | | |
|---|---|---|---|
| JP | 62072999 A | * | 4/1987 |
| JP | 10121071 A | * | 5/1998 |

(Continued)

OTHER PUBLICATIONS

Crawford, D.B. and Eschenbrenner, G.P. "Heat Transfer Equipment for LNG," Chemical Engineering Progress, Sep. 1972.

(Continued)

*Primary Examiner* — Frantz Jules
*Assistant Examiner* — Joseph Trpisovsky
(74) *Attorney, Agent, or Firm* — KBR IP Legal Dept.

(57) ABSTRACT

A method of altering the heating value of a liquefied natural gas by adding higher heating value components is disclosed. A portion of the liquefied natural gas is used to cool the higher heating value component stream prior to combining the higher heating value components with the liquefied natural gas to obtain a combined stream having a heating value greater than the liquefied natural gas.

22 Claims, 18 Drawing Sheets

U.S. PATENT DOCUMENTS

| | | | | |
|---|---|---|---|---|
| 6,604,380 | B1 | 8/2003 | Reddick et al. | |
| 2005/0126220 | A1* | 6/2005 | Ward | 62/625 |
| 2005/0204625 | A1* | 9/2005 | Briscoe et al. | 48/127.3 |
| 2006/0260468 | A1* | 11/2006 | Amin | 95/153 |
| 2008/0202161 | A1* | 8/2008 | Vazquez-Esparragoza et al. | 62/620 |
| 2009/0025422 | A1* | 1/2009 | Sicinski et al. | 62/613 |

FOREIGN PATENT DOCUMENTS

| | | | | |
|---|---|---|---|---|
| JP | 10185886 | A | * | 7/1998 |
| JP | 2001208297 | A | * | 8/2001 |

OTHER PUBLICATIONS

Shah, J.T. and de la Vega, F. "Advisory System for LNG Storage Facilities Uses KBS Technology," Expert Systems Applications, Oct. 1991.

Collins, C. "Developments in LNG Trade & Technology," GPA European Chapter LNG Meeting, London, Nov. 28, 1991.

Quinlan, M.P. and Echterhoff, L.W. "Technical and Economic Comparison of LO-CAT II with Other Iron-based Liquid Redox Processes," GRI Liquid Redox Sulfur Recovery Conference, Austin, Oct. 4-6, 1992.

McKee, R.L., Echterhoff, L.W., and Hertz, D.W. "Control of Aromatics Emission for Glycol Dehydration Units: A Look at Novel Approaches," Summer National AIChE Meeting, Seattle, Aug. 15-18, 1993.

de la Vega, F., Durr, C., Hill, D.K., and Collins, C. "Plant Reliability Analysis in LNG Plants," LNG 11 Conference, Birmingham, UK, 1995.

Collins, C. "LNG Technologies, Challenges, Regulations, and Safety," IBD Conference, London, Dec. 1997.

Rios, J., Coyle, D.A., Durr, C.A., and Frankie, B. "Removal of Trace Mercury Contaminants from Gas and Liquid Streams in the LNG and Gas Processing Industry," GPA 77th Annual Convention, Mar. 16-18, 1998.

Collins, C. and Durr, C.A. "Cost Reduction for LNG Export & Import Facilties," Prepared for the SMi Conference Understanding and Improving the Economics of Liquefied Natural Gas, London, Jan. 25-26, 1999.

Mayer, M., Robertson, A., Sheffield., Courtay, R., and Harr, R. "Safe Production of LNG on an FPSO," GasTech 2000.

Patel, D., Tarlowski, J., and Collins, C. "Developments in LNG Storage," SMI Conference, Feb. 2000.

Sheffield, J.A. and Mayer, M. "The Challenges of Floating LNG Facilities," GPA Spring Meeting, Norwich, 2001.

Lynn, S., Quinlan, M.P., Velasquez, D., and Leppin, D. "New Approach to Sulfur Removal Could Reduce Costs," GasTIPS, Winter 2002.

Jones, R., Sawchuk, J., and Davis, K. "Big Green Train," AIChE Spring Meeting, 2003.

Kotzot, Heinz J. "Overview of the LNG Industry Seminar: Gas Treatment, Liquefaction, and Storage," GPA Convention, San Antonio, Mar. 2003.

Jones, R., Sawchuk, J., Durr, C. and Davis, K. "BP's Big Green Train: Benchmarking Next Generation LNG Plant Designs," LNG 14, Doha, Qatar, Mar. 2004.

Durr, C. and de la Vega, F. "Designing Safety into LNG Export/Import Plants," LNG 14, Doha, Qatar, Mar. 2004.

Jamieson, A. and Durr, C. "Nigeria LNG—Overcoming Technical and Commercial Challenges to Become One of the World's Major Exporters of LNG," LNG 14, Doha, Qatar, Mar. 2004.

Songhurst, B. "LNG Update," GPA Europe Conference, Dublin, May 19-21, 2004.

Durr, C., Coyle, D., Hill, D., and Smith, Sharon, "LNG Technology for the Commercially Minded," GasTech 2005.

Shah, P. and Durr, C. "Monetizing Stranded Gas," SPE Handbook Chapter, 2005.

Cho, J., de la Vega, F., Kotzot, H., and Durr, C. "Innovative Gas Processing with Various LNG Sources," LNG Journal, Jan./Feb. 2005.

Townsend, B. and Khaligh, B. "Opportunities for Elegant Power Systems Design in LNG," SMi LNG Conference, London, Feb. 21-22, 2005.

Durr, C., Caswell, C., Echterhoff, L., Hill, D.K., and Coyle, D.A. "LNG Technology is on the Move: The Only Thing Constant is Change . . . " GasTech, Bilbao, Spain, Mar. 2005.

Coyle, D.A. and Patel, V. "Processes and Pump Services in the LNG Industry," 22nd International Pump Users Symposium, Houston, Feb. 28-Mar. 3, 2005.

Attaway, D.A., Huang, S., Kotzot, H., and Durr, C.A. "Optimal Process Location for NGL Recovery in LNG Plant," AIChE Spring National Meeting, 2005.

Coyle, D., Durr, C., and Shah, P. "LNG: A Proven Stranded Gas Monetization Option," SPE Annual Technical Conference and Exhibition, Denver, Oct. 5-8, 2005.

Coyle, D., de la Vega, F., Durr, C. "Natural Gas Specification Challenges in the LNG Industry," LNG 15 Conference, Barcelona, Spain, Apr. 24-27, 2007.

* cited by examiner

METHOD FOR LIQUEFACTION OF NATURAL GAS

BACKGROUND

1. Field

The present embodiments generally relate to liquefied hydrocarbon fluids, and to methods and apparatus for processing such fluids. Natural gas is an important energy source that is obtained from subterranean wells; however, natural gas is sometimes impractical or impossible to transport natural gas by pipeline from the wells where it is produced to the sites where it is needed, due to excessive distance or geographical barriers such as oceans. In such situations, liquefaction of natural gas offers an alternative way of transporting natural gas.

2. Description of the Related Art

Natural gas can be converted to liquefied natural gas (LNG) by cooling it to about −161° C., depending on its exact composition, which reduces its volume to about 1/600th of its original value. This reduction in volume can make transportation more economical. The liquefied natural gas (LNG) can be transferred to a cryogenic storage tank located on an ocean-going ship. Once the ship arrives at its destination, the LNG can be offloaded to a regasification facility, in which it is converted back into gas by heating it. Once the LNG has been regasified, the natural gas can be transported by pipeline or other means to a location where the natural gas can be used as a fuel or a raw material for manufacturing other chemicals.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
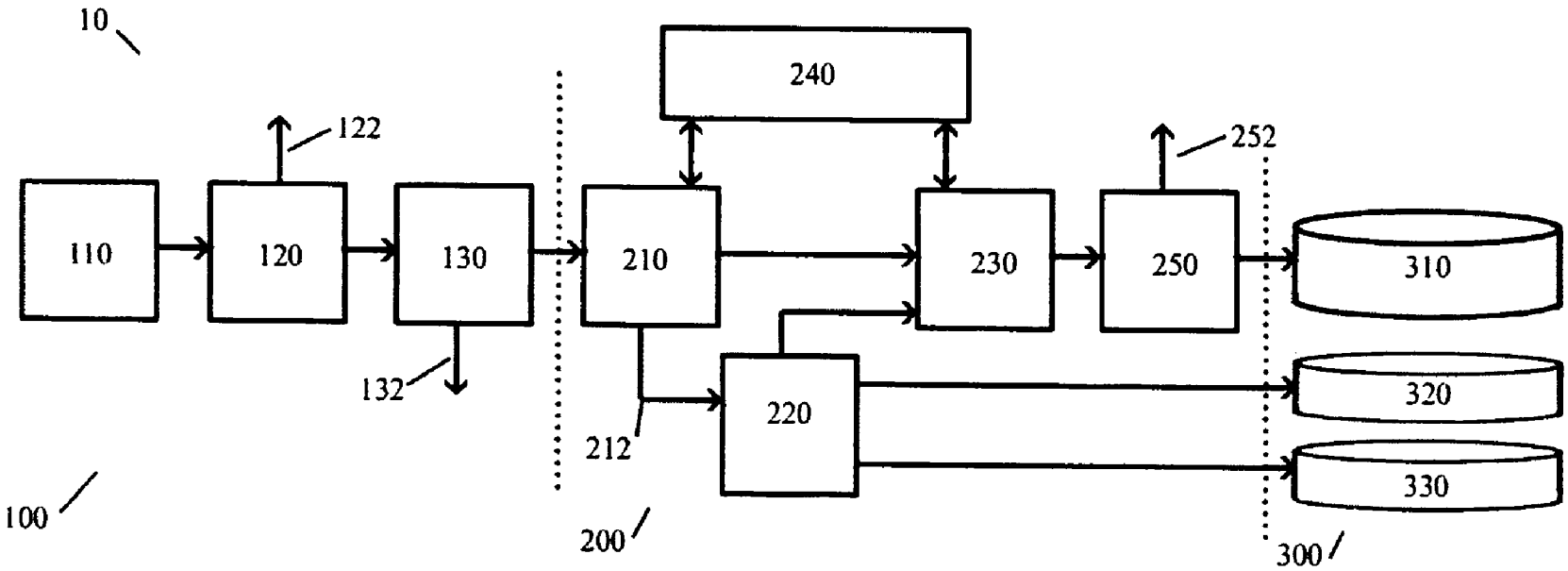
FIG. 1 depicts a block flow diagram on one embodiment of an LNG liquefaction system.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

One embodiment of the present invention is a method of altering the heating value of a liquefied natural gas stream that includes providing a first liquefied hydrocarbon composed of at least 90 wt % methane, having a temperature of about −150° C. or less and having a first heating value, in a first storage vessel and providing a second liquefied hydrocarbon composed primarily of one or more of ethane, propane, and butane, or mixtures thereof. A first stream of the first liquefied hydrocarbon is provided from the first storage vessel, from which a portion is compressed to form a second stream having a pressure higher than the first stream. Passing the second stream through the cold side of a first heat exchanger to obtain a third stream of first liquefied hydrocarbon with a higher temperature than the second stream and decompressing the third stream in a first liquid expander to obtain a fourth stream. The first liquefied hydrocarbon of the fourth stream is returned back to the first liquefied hydrocarbon storage vessel. A fifth stream of the second liquefied hydrocarbon is provided that is compressed to obtain a sixth stream which is passed through the warm side of the first heat exchanger to cool the sixth stream and obtain a seventh stream of second liquefied hydrocarbon with a lower temperature than the sixth stream. A first portion of the seventh stream is combined with the first stream to obtain an eighth stream having a second heating value greater than the first heating value of the first liquefied hydrocarbon.

The first liquid expander can provide static expansion to the third stream to obtain the fourth stream. The method can also include diverting a second portion of the seventh stream and decompressing that stream in a second liquid expander to form a ninth stream and injecting the ninth stream into the fifth stream. The second portion of the seventh stream can range from 0% to 100% of the seventh stream. The second liquid expander can provide static expansion to a portion of the seventh stream to obtain the ninth stream.

The flow of the seventh stream into the first stream can be regulated to control the heating value of the eighth stream. The temperature of the seventh stream in some embodiments is no more than 50° C. warmer than the temperature of the first stream. The temperature of the seventh stream in some embodiments is no more than 25 C warmer than the temperature of the first stream. The high heating value of the eighth stream in embodiments can be 1050 Btu/SCF (39.1 MJ/Sm3) or greater.

The pressure of the third stream can be sufficient to keep the third stream in a liquid state and in some embodiments is no warmer than −100° C. The temperature of the seventh stream can be cold enough to prevent cavitations as the seventh stream is combined with the first stream.

The temperature approach on the first heat exchanger between the third stream and the sixth stream can be less than 20° C. The temperature approach on the first heat exchanger between the second stream and the seventh stream can be less than 20° C. The flow of the ninth stream can be regulated to maintain a temperature approach on the first heat exchanger between the third stream and the sixth stream of less than 20° C. The flow of the ninth stream can be regulated to maintain a temperature approach on the first heat exchanger between the second stream and the seventh stream at no more than 20° C. The method can further include loading the eighth stream onto an LNG transport vessel. The temperature of the fifth stream can be 0 C or less or can be −30° C. or less. The first heat exchanger can be one or more plate-fin type exchangers.

An alternate embodiment of the present invention is a method of modifying the heating value of a liquefied natural gas stream that includes providing a first liquefied hydrocarbon (LNG) composed of at least 90 wt % methane, and having a first heating value; providing a second liquefied hydrocarbon (LPG) composed primarily of one or more of ethane, propane, and butane, or mixtures thereof; passing a first stream of the LNG from the first storage vessel, through a first heat exchanger to provide cooling energy; passing a second stream of the LPG through the first heat exchanger to obtain a third stream of LPG with reduced temperature; providing a fourth stream of LNG; blending a first portion of the LPG of the third stream with the LNG of the fourth stream to obtain a fifth stream of LNG containing increased content of LPG and thus having a heating value greater than the first heating value of the first liquefied hydrocarbon.

The method can further include returning the warmed first stream exiting the first heat exchanger to the first storage vessel. The first heat exchanger can comprise one or more plate-fin type exchangers. The temperature of the third stream exiting the first heat exchanger in some embodiments can be no more than 50° C. warmer than the temperature of the first stream entering the first heat exchanger, or no more than 25° C. warmer than the temperature of the first stream entering the first heat exchanger or no more than 10° C. warmer than the temperature of the first stream entering the first heat exchanger. The method can further include blending a second portion of the third stream exiting the first heat exchanger into the second stream prior to entering the first heat exchanger. The method can further include loading the fifth stream onto an LNG transport vessel.

Illustrative Embodiments

Liquefaction of natural gas to produce the product liquefied natural gas (LNG) can be conducted in a facility called a liquefaction plant which cools the natural gas to about −161° C., and reduces its volume to about 1/600th of its original value. Liquefaction plants are generally built as either peak-shaving or as base-load plants, depending on their function in the overall natural gas flow. Peak-shaving facilities are relatively small (in the hundred thousand tons per year range) to provide a buffer between a more constant supply and a highly fluctuating demand. These facilities typically liquefy natural gas during periods of low demand and vaporize natural gas at times of peak demand. Base-load plants liquefy several million tons of natural gas per year for ship transportation to the consumer. A few small plants also exist for the purpose of delivering LNG locally by road or rail tanker when alternate transport is deemed more economical than pipeline delivery.

Although the construction of a liquefaction plant is typically the single largest cost element, large investments are also needed throughout the gas supply chain in areas such as exploration, construction of specialized ships for LNG transportation, and in receiving terminals for unloading of LNG from the ships and regasification of the LNG to natural gas in vapor form. The main technical challenge is to minimize the costs of a supply chain while maintaining the high level of safety, availability, and longevity. The LNG supply chain typically includes the following processes: natural gas production and transportation to the liquefaction facility; gas treatment; liquefaction of the gas to LNG; LNG storage; loading of LNG onto transport vessels; transportation; unloading of LNG at a receiving terminal; LNG storage; regasification of the LNG and delivery to a gas pipeline; or an onsite electrical power generation facility.

Feed Gas

Natural gas can be produced from a field of subterranean wells. Raw natural gas contains primarily methane. Raw natural gas also can contain smaller amounts of ethane, propane, n-butane, isobutane, and heavier hydrocarbons, as well as water, nitrogen, helium, mercury, and acid gases such as carbon dioxide, hydrogen sulfide, and mercaptans. Raw natural gas can be classified as either associated gas (which is produced from reservoirs that also contain substantial amounts of oil) or non-associated gas (which is produced from reservoirs that generally contain little or no oil).

Components that are commonly removed from the feed gas include: carbon dioxide, hydrogen sulfide, sulfur compounds, aromatics, water, mercury, nitrogen and heavier hydrocarbons. A mixture of ethane, propane, n-butane, isobutane, and in some cases heavier hydrocarbons can be separated from natural gas and recovered as a product referred to as natural gas liquids (NGL). A mixture primarily propane and butanes can also be recovered as a product referred to as liquefied petroleum gas (LPG). Natural gas that has a relatively high NGL and/or LPG content is sometimes referred to as "rich" gas and natural gas that contains a relatively low NGL and/or LPG concentration is sometimes referred to as "lean" gas.

In some embodiments, some processing of the produced gas can be performed near the well; for example, in order to prevent or minimize dropout of hydrocarbon liquids, formation of hydrates, and pipeline corrosion during transportation from the well to a plant at which more extensive processing can take place. After any processing that takes place in or near the well, the natural gas can be transported to a liquefaction plant, for example by pipeline.

With reference to the figures, FIG. 1 depicts a block flow diagram of one embodiment of an LNG liquefaction system. The depicted generalized LNG liquefaction plant block flow diagram illustrates the major components of an overall LNG liquefaction facility 10 such as a gas treating section 100, a liquefaction/refrigeration section 200, and an LNG send out and storage section 300. A gas treating section 100 can comprise gas reception facilities 110, acid gas removal unit 120, and dehydration/mercury removal unit 130. The liquefaction section 200 can comprise an initial cooling/condensing unit 210 to remove heavier hydrocarbons, liquid removal with fractionation 220, liquefaction 230, refrigeration system 240, and endflash/nitrogen rejection unit 250. An LNG send out and storage section 300 can comprise storage for the LNG 310, LNG/LPG 320, and heavier hydrocarbon liquids 330 that are sometimes referred to as gasoline. The acid gas removal unit 120 can remove hydrogen sulfide, carbon dioxide, and other impurities via line 122. The dehydration/mercury removal unit 130 can remove water and mercury as illustrated via line 132. The endflash/nitrogen rejection unit 250 can remove nitrogen as illustrated via line 252. In some facilities, a helium-rich stream also is produced for further processing in a helium plant.

Gas Treating

Carbon dioxide, water, aromatics, and heavier hydrocarbons can freeze on the heat transfer surfaces of heat exchangers at cryogenic temperatures. Mercury can cause degradation of aluminum, which is used in some low temperature heat exchangers. Excessive concentrations of sulfur can also be undesirable in natural gas and their removal may be dictated by the end-user gas specification. Therefore, the gas treating section of a liquefaction plant can include apparatus for removing at least a portion of these substances. In one embodiment, a gas treating section can comprise an inlet/pre-treatment section, an acid gas removal section, a dehydration section, a mercury removal section, and a particle filtration section.

Gas Reception Facilities: The inlet/pre-treatment section can remove solid and liquid phase materials and impurities from the natural gas feed stream. These facilities can separate out heavy liquid hydrocarbons that have condensed from the natural gas. This liquid can be primarily a $C_5$ and higher condensate, and can be sent either to a NGL fractionation unit or directly to NGL storage tanks. A condensate stabilization facility can remove any associated sour gas from the condensate and can compress it back into the natural gas stream. The pressure of the feed gas can be reduced at this point if the feed gas pipeline pressure is higher than the LNG plant operating pressure. Alternatively, feed gas arriving at low pressure can be compressed to reach the desired LNG plant operating pressure.

Particle Removal: A particle filtration section can reduce the concentration of particulate matter, for example by filtration, in order to prevent plugging of downstream equipment.

Acid Gas Removal Unit: The acid gas removal section can remove carbon dioxide and sulfur-containing components such as hydrogen sulfide that are present in the natural gas feed. Acid gases can be removed by processes such as treatment with chemical solvents, physical solvents, adsorption processes, or physical separation. For example, amine processes can be used for acid gas treatment, in which an aqueous solution of an alkanolamine is contacted with the gas and removes at least some of the sulfur compounds. Off gases from the acid gas treatment unit can be sent to a Claus unit for sulfur recovery if the recoverable sulfur is sufficiently large. If the quantity of sulfur is small, the off gas can be incinerated or the sulfur in the acid gas stream can be further enriched in an acid gas enrichment process upstream of a Claus unit. Off gas also can be further treated with one or more scavenger processes. MDEA, usually applied with a proprietary activator to facilitate gas pickup, tends to be less corrosive and has lower regeneration heat duties than other amines.

Some processes used for removal of carbon dioxide and sulfur compounds include the use of MEA (monoethanolamine), MDEA (methyl diethanol amine), and proprietary compounds such as a-MDEA (BASF), Sulfinol (Shell) and the Benfield Hi Pure process and Mol Sieve Benfield (MSB) process (UOP). The latter process also includes dehydration of the feed gas by co-adsorption of water and residual carbon dioxide leaving the hot carbonate absorption section. The use of membrane/amine and cryogenic fractionation schemes have also been proposed for high $CO_2$ feed gas. In certain installations two absorbers have been provided in each process train. The use of packing, including structured packing, sometimes enables the use of a single absorber vessel for a single process train with a high feed gas rate. When considering these and other processes, particular attention must be given to the feed gas composition, product specifications and the distribution of impurities between the various streams used for make up to refrigerant circuits.

Membrane, Amine and Hybrid Systems: Membrane systems have shown to be an economically and operationally viable alternative for gas processing. An economic comparison of membrane, amine, and membrane/amine hybrid processing schemes can be conducted to determine when installation of a hybrid system may be advantageous for $CO_2$ removal associated with LNG production.

Amine units increase their energy usage when the $CO_2$ concentration increases. Membranes, on the other hand, use partial pressure as the driving force and are most effective at high concentrations of $CO_2$. In a hybrid system the membrane can remove the bulk of the $CO_2$ with a relatively small area and the amine is used for the final cleanup to achieve the required $CO_2$ specification. The advantage of this is that bulk removal with membranes may reduce capital and operating costs when compared to conventional processes. The savings between membrane and amine increases as the $CO_2$ content increases. Increasing $CO_2$ partial pressure favors membrane systems, whereas, amine solution loading is limited by corrosivity considerations. As the feed gas price increases, the hybrid system's range of operability increases. This trend occurs, again, because the membrane system's economics are governed by the loss of hydrocarbons. It is important to note that the hybrid system does not take applicability away from the membranes but rather increases the range of applicability.

Figure 18:
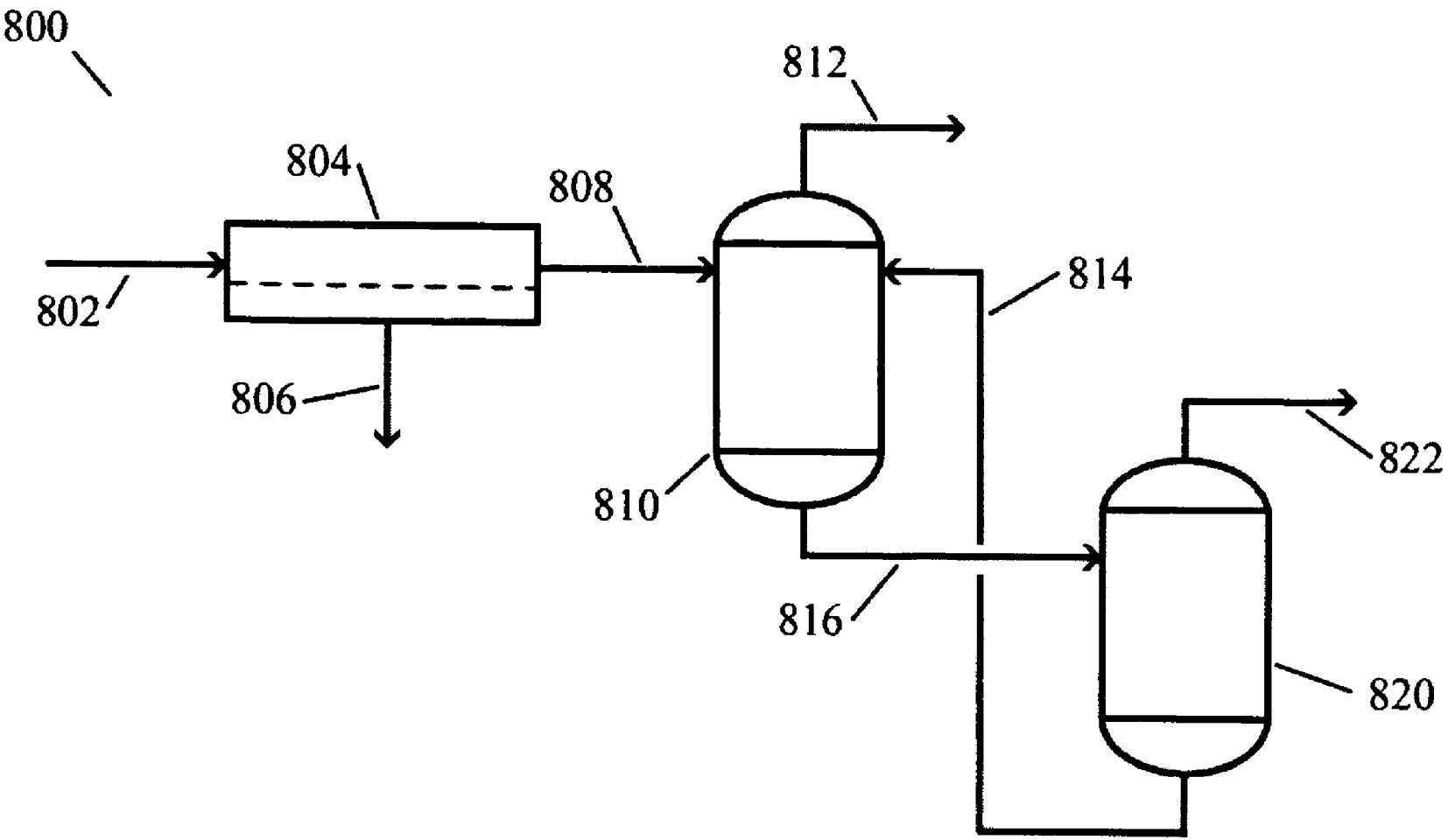
FIG. 18 depicts a schematic illustration of a hybrid amine/membrane CO2 extraction system.

FIG. 18 depicts a schematic illustration of a hybrid amine/membrane CO2 extraction system. The hybrid process 800 includes a feed gas stream 802 that flows through a membrane 804 that removes acid gas via line 806 and a partially processed gas stream via 808. The partially processed gas stream 808 enters an amine contactor 810 that produces processed gas via line 812. $CO_2$ lean amine enters the amine contactor 810 via line 814 while $CO_2$ rich amine leaves the amine contactor 810 via line 816 and flows to an amine stripper 820 where $CO_2$ and possibly other gasses are released by heating and reducing pressure and leaves the amine stripper 820 via line 822.

Sulfur Extraction: Research into catalysts that can effect the direct oxidation of hydrogen sulfide to sulfur has been conducted, for example by TDA Research. Direct oxidation of hydrogen sulfide in a single reactor vessel, capable of processing less concentrated sulfur streams, could be beneficial because of its simplicity and small footprint. Modified Claus processes have many commercial applications, but typically require a more concentrated hydrogen sulfide stream.

Dehydration

Figure 2:
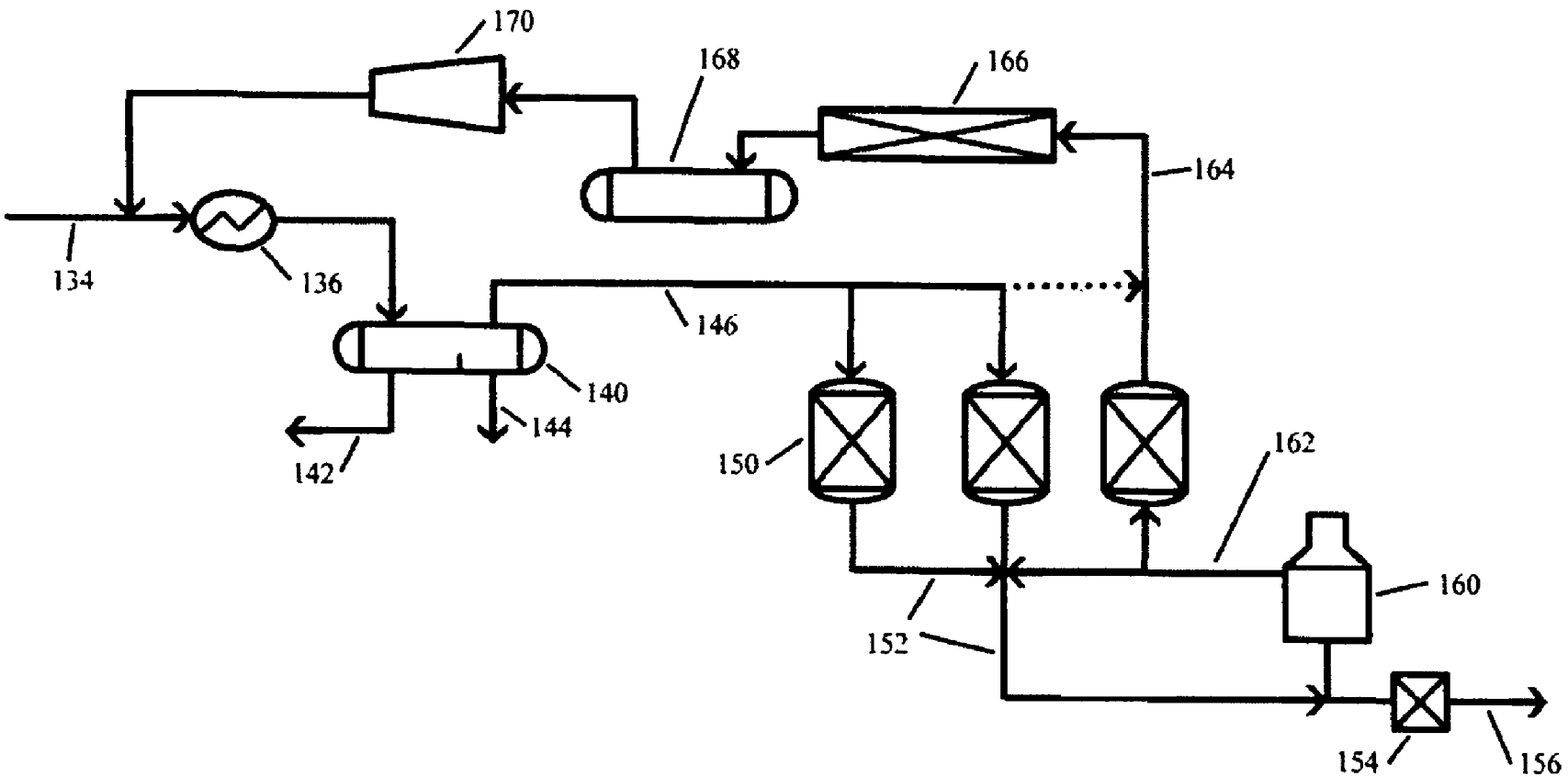
FIG. 2 depicts a schematic illustration of a dehydration unit.

The dehydration section can remove water from the gas to prevent hydrate formation and freezing in the cryogenic section of the plant. The dehydration unit sometimes removes sulfur compounds also, such as RSH, COS and $CS_2$. FIG. 2 depicts a schematic illustration of a dehydration unit. In FIG. 2, the inlet gas 134 can be cooled to a point above the hydrate formation temperature using air or water coolers 136 and refrigerant. Free liquid water that is condensed can be separated in a separator 140 and removed via line 142, hydrocarbon liquids can be separated and removed via line 144 and the remaining gas can be fed via line 146 to one or more molecular sieve adsorption unit(s) 150 for removal of water vapor down to the desired maximum concentration. The dried gas leaves the molecular sieve adsorption unit(s) 150 via line 152 and can pass through one or more filters 154, and leaves via line 156 to the liquefaction section. A regeneration heater 160 can be used to heat a portion of the dehydrated gas 162 for flow through the molecular sieve adsorption unit(s) 150 for regeneration. After the heated gas flows through the molecular sieve adsorption unit(s) 150 they exit via line 164 and to a regeneration cooler 166, a regeneration gas knockout drum 168 and a regeneration gas compressor 170 and are injected back into the inlet gas stream. Options for dehydration in various embodiments can include two or three dehydration beds, high or low regeneration pressure (high pressure regeneration gas requires only little re-compression if returned to the acid gas removal section). Other options include the regeneration gas source; the source to use for regeneration heat (for example, heat can be provided from various heat sources available in the plant); and regeneration gas to fuel instead of its reinjection into an inlet gas stream.

Drying with fixed-bed desiccants: When activated desiccant is brought into contact with a gas of high humidity, the pressure of the water vapor in the adsorbent tends to reach equilibrium with the pressure of the water vapor in the surrounding gas. Hence the moisture content of the gas is decreased. Physical adsorption is a continuous process. Adsorbed molecules break away from the adsorbent when they acquire sufficient energy. When the rate at which water molecules leave the adsorbent is equal to the rate at which they are being adsorbed on the surface, equilibrium is established and no further adsorption takes place. The amount of water adsorbed at equilibrium increases with higher partial pressure of the water in the gas, and decreases with higher temperatures. The desiccant is said to be saturated (for a given set of conditions) when equilibrium is attained, and the amount of water adsorbed at this point is known as the equilibrium capacity or static capacity. In an embodiment of a dehydration unit the water vapor of the processed gas is reduced to below 0.1 ppmv.

At the start of operation with a freshly reactivated desiccant, the moisture or other adsorbate is removed from the flowing gas stream at the inlet section of the bed. The distance required for this removal is the depth of bed known as the adsorption zone. This zone moves through the bed at a uniform rate depending on the operating conditions, and the effluent moisture from the bed will be at a low value until the adsorption zone reaches the exit end of the bed. A small amount of additional adsorption occurs at the inlet section; but the rate of adsorption is relatively low after the adsorption zone has passed, and there is usually insufficient time for equilibrium to be established between gas and desiccant. When the leading edge of the adsorption zone reaches the exit end of the bed, the effluent moisture rises rapidly from then on. Depth of the adsorption zone and the rate at which the adsorption zone moves through the bed will be determined by a number of variables. These include gas temperature and moisture content, desiccant type and particle size, bed depth and configuration, flow rate and pressure of the gas.

Mercury Removal

Mercury, often present in trace amounts, attacks piping and equipment made from aluminum and aluminum compounds. The mercury removal section can lower the mercury concentration in the natural gas to prevent corrosion of aluminum equipment in the liquefaction process. Mercury must be removed prior to the feed gas entering the cryogenic sections of the LNG plant. The mercury removal vessel is usually placed after the dehydration unit, but can also be located upstream of an acid gas removal unit. Mercury can be removed from the gas by reaction with elemental sulfur to form a sulfide. The sulfur can be supported on a high surface area solid carbon bed. This can be a non-regenerative process and the spent carbon bed can be disposed of in a landfill or can be returned to a catalyst vendor for reclaiming. Filtering of the gas stream is typically required to prevent any solid particles from being carried with the gas into the subsequent sections of the liquefaction plant.

Mercury Forms: Mercury is present in natural gas and natural gas associated condensates, as organometallic and inorganic compounds, and in the elemental (metallic) form depending on the origin of the gas. The elemental form can be found in either the vapor or liquid phase. The organometallic (typically dimethyl mercury, methylethyl mercury, or diethyl mercury) and inorganic (such as HgCl2) compounds drop into the liquid phase in any fractionation of the natural gas streams. Vapor phase elemental mercury is a primary culprit in corrosion of aluminum exchangers inside cryogenic cold boxes. Elemental mercury that leaves the plant in the liquid phase natural gas condensate streams is a primary source of corrosion in aluminum equipment in olefin plants that crack NGL recovered from the natural gas plants. Mercury also poisons the selective hydrogenation catalysts in olefin plants, and can pose inhalation hazards to workers. Organometallic and inorganic mercury usually end up in the condensate stream from the natural gas plant. These compounds are important environmental toxins that are easily absorbed and accumulated by biological organisms. The presence of these compounds in natural gas condensate streams leads to waste disposal problems and safety hazards to workers.

Mercury Detection: Problems with mercury detection mean that operators will often have no indication of impending trouble until failure of an equipment item due to mercury induced corrosion. Since mercury can be present in very low levels in natural gas streams it is difficult to determining which streams are contaminated, and the degree of contamination. Detection methods continue to improve, however. A number of available analyzers now claim capability at the parts per trillion by volume (pptv) level. These methods can comprise passing a sample stream through a mercury trap (dosimeter) over a long collection period, and then desorbing the mercury from the trap as a concentrated pulse into a detector. Primary methods for elemental mercury detection in the gas include gold filament analyzers, cold vapor atomic fluorescence (CVAF), peroxide scrubbing, and ICP/mass spec. CVAF can be a preferred method for laboratory work, as CVAF is very sensitive. It has been reported that accurate and consistent results measuring mercury levels in the feed and treated gas can be obtained using the Jerome Model 431 mercury analyzer to less than 0.001 ug/Nm3 using the gold wire trap, provided that the sample lines are kept ultra-clean over the required long collection period. Another company installed a continuous online sampling system that could accurately measure mercury down to the 0.001 ug/Nm3 level, and found that the Sir Galahad system by P S Analytical Ltd. (atomic fluorescence spectrometry) unit could be adapted. All of the methods mentioned above are gradually being improved to more accurately detect ppbv levels in the feed gas, and the pptv required in the treated gas. However they still have some problems, for example, gold filament analyzers, which are the most frequently used detection instrument, can have trouble measuring organometallic mercury, are sensitive to temperature changes, moisture, H2S, and mercaptans in the gas, and cannot measure the gas at operating pressures. For liquid analysis there are two known models: Nippon Instrument Cop. Model SP-3D (uses an atomic absorption detector), and the PS Analytical Ltd Merlin model (which uses an electron fluorescence detector). One company had the analytical capability to analyze liquid samples including naphthas and natural gas condensates, and had developed a method to differentiate between the various species. Levels as low as 0.1 ppb wt. can be quantified. The most accurate measurements should be done at operating conditions and over a prolonged collection period. As a further complication to the situation, mercury levels in natural gas have been reported to fluctuate by a factor of five over periods longer than eight hours. In addition, when samples are collected in the field and brought to the lab, some of the mercury is adsorbed on the container walls, resulting in lower readings.

Scavenging Elemental Mercury from the Vapor Phase: Scavenging elemental mercury and organometallic compounds from the feedstock(s) of gas plants is a maturing technology for mercury removal. Elemental mercury can be readily trapped by contact with sulfur based trapping agents. The principle commercial trapping agents include sulfur, metal sulfides, silver and gold. The types of support materials or carrier agents include activated carbon, alumina and other zeolite materials. Operating temperatures range from ambient to 100 C, and at pressures up to 100 bar. Elemental mercury in the gas phase is readily trapped by sulfur based trapping materials which fixes the volatile mercury in the form of non-volatile mercury sulfide (HgS). Most commonly, an activated carbon is chemically treated or impregnated with a mercury-fixing compound such as sulfur or iodine. The mercury is chemisorbed onto the non-retentive carbon which must be periodically replaced (typically every 3-4 years).

Removing Organometallic Mercury from the Liquid Phase: Less work has been done on the problem of removal of organometallic mercury from liquid streams than the removing of elemental mercury in the vapor phase. The current leading approaches involve adsorption onto a carbon or molecular sieve, and the use of ion exchange resins, such as: ALCOA Mersorb LH (Impregnated pelletized activated carbon); Calgon Type HGR-IS (Potassium iodide impregnated granular activated carbon); Stamicarbon Ion Exchange Process (Ion exchange resin with thiol groups); ICI Katalco n/1E32LEsPECTM 1157 (a fixed bed chemical absorbent—mixed metal oxides with cementitious binder that can be used for removal of elemental mercury in liquid streams such as NGL liquids and LPG); and/or UOP HgSIV (Regenerative molecular sieve containing silver that can be used for removal of elemental mercury in liquid streams such as NGL liquids and LPG).

Another method for organometallic mercury removal is the IFP/Procatalyse process which, through hydrogenolysis of the organometallic compounds at moderate conditions on a catalyst bed reactor, yields metallic mercury. The elemental mercury thus produced is then trapped at a lower temperature in a second reactor on a bed of the Procatalyse CMG-273 catalyst.

New Mercury Treatments: A number of new treatments show promise for helping meet mercury waste specifications. Physical separation technologies based on the high density of mercury are used to treat contaminated soils and have some effectiveness at bulk removal. However, physical separation cannot remove the mercury that absorbs into soil, or mercury chemically bonded to scavenger catalysts. Biological treatments use bacteria to concentrate organic mercury compounds. Immobilization technologies reduce the leach ability of mercury into groundwater from contaminated soils. Chemical treatments show promise in providing an alternative to thermal treatment. These technologies typically use an acid to leach the mercury from the contaminated material. New approaches suggest using an organic chelating agent from which the mercury can be recovered.

Natural Gas Specification

In some embodiments of the process, the natural gas after treatment of can have the following maximum concentrations of the listed components:

a) hydrogen sulfide 3-4 ppmv
b) total sulfur 30 mg per normal cubic meter
c) carbon dioxide 50 ppmv
d) mercury 0.01 μg per normal cubic meter (0.013 ppb by weight)
e) nitrogen 1 mol %
f) water vapor 1 ppmv
g) benzene 1 ppmv
h) ethane 6-8 mol %
i) propane 3 mol %
j) butane and heavier hydrocarbons 2 mol %
k) pentane and heavier hydrocarbons 1 mol %

The desired maximums for the various components can vary, depending for example on the desired heating value of the gas. In some embodiments, the high heating value of the gas can be from about 1050 to about 1100 BTU/SCF. In some embodiments the high heating value can be specified to be 1065 BTU/SCF or greater.

Liquefaction/Refrigeration Section

Referring back to FIG. 1, in one embodiment, a liquefaction/refrigeration section 200 can comprise a feed gas cooling and NGL condensation section 210, a fractionation section 220, a liquefaction section 230, a refrigeration section 240, and an endflash section 250.

Initial Cooling to Remove Heavier Hydrocarbons: The feed gas cooling and NGL condensation section 210 can separate ethane and heavier hydrocarbons from the feed gas to adjust the heating value and to remove benzene. Initial chilling can be provided, for example, by the first stage of a propane refrigeration cycle (e.g., cascade and propane precooled mixed refrigerant) or in a warm heat exchanger of a mixed refrigerant (MR) process. For this initial cooling, kettle or core-in-kettle type exchangers can be used if the temperature remains above the minimum for carbon steel applications. At lower temperatures, for which special materials can be required, plate fin (PF) or spiral wound (SW) aluminum exchangers can be used.

Precooling and Liquefaction: One process development involves replacement of propane precooling with a multicomponent refrigerant system. This alternative enables precooling to a lower temperature than that allowed by using atmospheric propane. Propane refrigeration at the interstage of the low temperature mixture refrigerant compression system has also been suggested for helping to balance the compressor power between the propane and mixed refrigerant systems. Other proposals include the use of vacuum propane and ammonia absorption refrigeration.

The number of Heat Transfer Units (HTU) in a heat exchanger is defined as the temperature drop of the warm stream (or temperature rise of the cold stream) divided by the average temperature difference between the warm and cold streams. Kettle type heat exchangers have a limited number of HTU while plate fin, spiral wound and other exchangers whose warm and cold flows are counter-current have greater limits on HTU.

The use of a multicomponent refrigerant for precooling excludes the use of conventional kettle type heat exchangers. Aluminum plate-fin heat exchangers have been proposed for this duty. Other types of heat exchangers have also been suggested for use in LNG plants such as Heatric, Packinox, and UOP High Flux Tubing. Another practice involves the use of hydraulic turbines instead of expansion valves on the LNG product and liquid mixed refrigerant streams. The advantage is due to the isentropic expansion of the liquid, with energy recovery, compared with isenthalpic expansion across a valve.

Liquid Removal: Heavy hydrocarbon components (e.g., aromatics and $C_5$ and higher aliphatic hydrocarbons) can be removed via line 212 to prevent them from freezing in the liquefaction section 230. Lighter components such as ethane and liquefied petroleum gas (LPG, comprising primarily propane) can be removed for one or more of the following purposes: to provide make-up refrigerant, to control the heating value of the LNG product, to prevent freezing of aromatics in the liquefaction process, or to allow separate sale of gas liquids as a product. The feed gas stream can be cooled such that the heavy hydrocarbon components (e.g., NGL) are condensed and then can be removed by vapor/liquid separation in a trayed column. The trayed column is sometimes referred to as a scrub column. If this column is re-boiled, the scrub column can also function as a demethanizer. Further separating of the liquid stream can be carried out in the fractionation section 220. The temperature to which the gas is cooled depends on the amount of LPG that is desired to be recovered.

Figure 3:
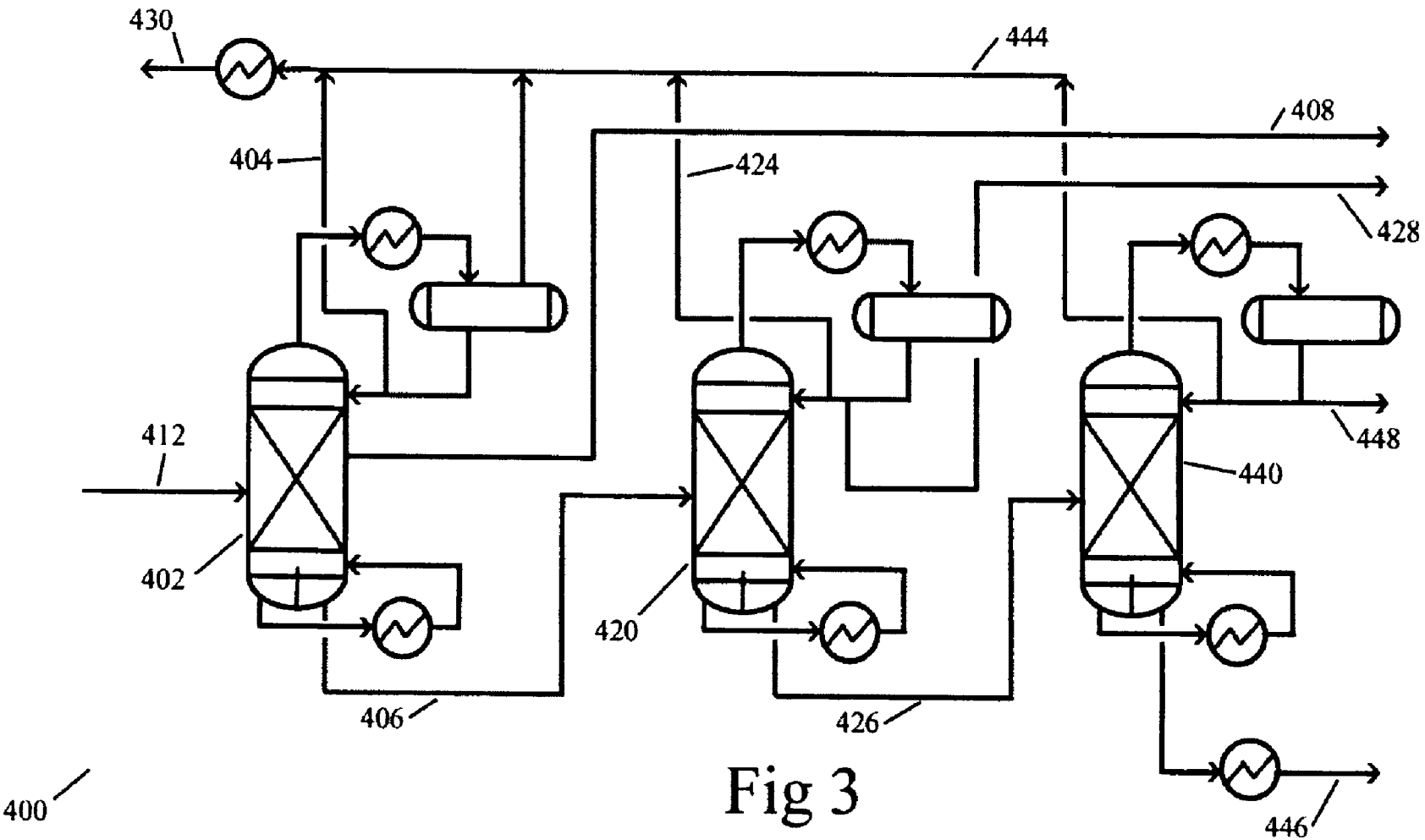
FIG. 3 depicts a schematic illustration of a NGL/LPG fractionation unit.

Fractionation: The liquids recovered from the natural gas, often comprising ethane through pentane, are called natural gas liquids or NGLs. The hydrocarbons in NGL can be recovered from the scrub column and separated in a fractionation train that comprises, for example, demethanizer, deethanizer, depropanizer, and debutanizer columns. The bottoms stream from the demethanizer can be fed to the deethanizer. The demethanizer can be eliminated if the upstream scrub column is re-boiled. The demethanizer overhead vapor can be returned to the natural gas feed stream or can be sent to the fuel gas system for the plant. FIG. 3 depicts a schematic illustration of a NGL/LPG fractionation unit. In FIG. 3, one embodiment of a fractionation train 400 to separate an inlet stream 412 is shown comprising a deethanizer 402, depropanizer 420, and debutanizer 440 columns. The bottoms stream 406 from the deethanizer can be fed to the depropanizer 420, and the bottoms from the depropanizer 426 can be fed to the debutanizer 440. The deethanizer overhead 404 can be returned to the natural gas stream, up to a desired limit. Alternatively, ethane can be collected for sale as an external product or can be used as fuel in the plant. A side draw stream 408 from the deethanizer column top section can be taken as liquid ethane to the refrigerant make-up system. This stream does not necessarily require stringent distillation because the make-up refrigerant can be a mixture with methane and propane. The bottom stream 406 from the deethanizer should be very lean on ethane if the downstream depropanizer is used to produce refrigerant grade pure propane (e.g., 99.5% propane).

Propane 428 and butane 448 can be recovered as liquids from the total condensers of the depropanizer 420 and debutanizer 440 columns. These liquids can be used for refrigerant make-up or sent to LPG storage via line 430. The bottoms stream 446 from the debutanizer 440 can be mixed with the condensate from the inlet/upstream section or can be used as a gasoline component.

Traditionally the removal of NGL from the feed gas has been integrated into the precooling section, which provides partial condensation for separation, an embodiment of this arrangement is shown in FIG. 1. However there are cases where front end NGL recovery, which is upstream of the gas cooling section, may be the preferred design. A study was conducted by KBR to compare the efficiency of front end versus integrated NGL recovery for an LNG production facility in a neutral approach to liquefaction technology. The study will use a generic liquefaction process as a basis for comparison. The analysis is not based on any proprietary liquefaction process. The NGL recovery technique varies with the placement in the process. Front end NGL recovery will use a conventional expander plant design with full pressure recovery. Integrated NGL recovery can employ different schemes, such as condensation by refrigerant or expander technology. A series of process simulations were used to model the liquefaction process with selected NGL recovery methods at various temperature levels in the feed gas chilling train. A comparison based on specific power was applied to evaluate the options. The results of this study can serve as a useful guideline for future process design. The configuration of the NGL recovery system by necessity changes somewhat as its placement within the chilling train varies. Two concepts were used as the basic approaches to NGL recovery for all of the cases considered. The first employed a high pressure column with external refrigeration to generate reflux for the required separation. The second used a traditional "expander plant" design utilizing feed gas expansion and recompression to provide the necessary refrigeration for the recovery cycle. This approach was further varied by looking at the impact of eliminating recompression.

In all cases, the refrigeration power was kept constant while the production rate was allowed to vary. This approach is consistently used in many facilities where the refrigeration compressors are driven by a fixed selection of gas turbine drivers. The power consumed by the recompressor, although included in the process specific power, is not considered as part of the refrigeration compression. The significance of this distinction is that it allows additional power to be applied to the process that can have an impact on the overall production rate. The end use of the recovered NGL can vary from site to site. In some cases, the recovered NGL will be exported as a separate product; in others, the recovered NGL is re-injected into the LNG product after satisfying refrigerant makeup requirements. In this study, the recovered NGL is not returned to the LNG product stream; therefore, the specific power, which is compression power referenced against LNG product rate, will inherently rise with increasing NGL recovery. The results of this study are that the optimum design of an NGL recovery system within an LNG production facility depends on the target objectives.

Low Specific Power/High Efficiency: From an efficiency standpoint there is a clear trend supporting an integrated NGL recovery system with a relatively cold feed. The data indicated a significant improvement in overall system performance with a −40° C. feed to NGL recovery compared to warmer draw points. There was virtually no change in specific power from a front end design (40° C. feed) to a −15° C. draw. Lower levels of ethane recovery offer the highest efficiency, which is as expected. Higher levels of NGL recovery consume additional power and reduce the LNG product stream.

When the specific power is measured relative to total liquid product, the overall trend is much less sensitive to the ethane recovery level.

High Production Rate: Under the basis of design conditions laid out in this study, high efficiency is not necessarily synonymous with high production rates. While refrigeration power is restricted to a fixed value, recompression power associated with NGL recovery is unconstrained. This presents the opportunity for additional power to be applied to the overall system, which can have a positive impact on production rates. This is best illustrated by noting that an NGL recovery feed temperature of −40° C., which corresponded to the best efficiency point, yielded the lowest production rate at all levels of ethane recovery. Varying the feed temperature to NGL recovery from 40° C. to −15° C. had relatively little impact. LNG production was highest at low ethane recovery levels, while total liquid production was highest at high ethane recovery levels. This demonstrated that although increasing NGL recovery pulled potential product away from the LNG stream, increasing NGL recovery allowed for processing a higher feed flow, which resulted in more total liquid production. For those processes where recompression power was not used, the highest product rate naturally corresponded to the highest efficiency point since the total power applied to the system remained constant.

Optimum System: As indicated in the sections above, this study did not indicate an optimum approach that was equally valid for all facilities. The constraints placed upon each design can shift the design philosophy in different directions. There does appear to be a best efficiency point that would support a colder feed to the NGL recovery system. There also appears to be an opportunity at warmer feed temperatures to apply additional power through recompression that can increase product yields in refrigeration constrained systems.

Liquefaction: The natural gas can be cooled by mechanical refrigeration. A refrigerant gas can be compressed, cooled, condensed, and let down in pressure through a valve that reduces its temperature by the Joule-Thompson effect. The refrigerant gas can then be used to cool the feed gas. Some constituents of the natural gas, such as propane, ethane, and methane can be used as refrigerants, either individually or in a mixture. Suitable types of liquefaction cycles include cascade, mixed refrigerant, and expansion cycles, as well as combinations of two or more thereof. The compressors used in the refrigeration system may be driven by steam turbines, gas turbines, electric motors or combinations thereof.

The dry lean gas is condensed in a cryogenic exchanger, sometimes referred to as a cold box or MCHE (main cryogenic heat exchanger) to an outlet temperature that will result in complete liquefaction of the feed gas. In at least some situations, the liquefaction pressure can be kept as high as possible and the outlet temperature can be kept as warm as possible to improve liquefaction efficiency. The exchanger outlet temperature can be close to −161° C. without subsequent endflash or liquid expansion. Plate fin (PF) and spiral or spool round (SW) exchangers can be used and can allow a close temperature approach. They are also very compact compared to the shell & tube exchangers.

The choice of operating pressure for the liquefaction plant can affect other aspects of the process and apparatus. Higher operating pressure reduces the refrigeration load, but the pressure can remain significantly below the cricondenbar (the highest point of the phase envelope, or the highest pressure at which two phases are still possible) to allow vapor/liquid separation.

If the composition of the feed gas is such that the NGL can be retained in the LNG while still meeting product specifications and without causing freezing problems, then the feed gas can pass through the LNG plant at the supercritical pipeline pressure. This can improve the efficiency of the liquefaction process and can simplify the facilities by eliminating NGL recovery and its liquid handling facilities. However, this alternative would not allow for recovering refrigerant make-up fluid without having an expander-compressor inclusion and could require importation of refrigerant.

With higher liquefaction pressure, less power is required by the liquefaction process. The higher pressure can also allow a higher outlet temperature from the main heat exchanger, which can result in a richer or heavier mixed refrigerant (MR) that can reduce refrigeration power requirements or increase the throughput.

Figure 4A:
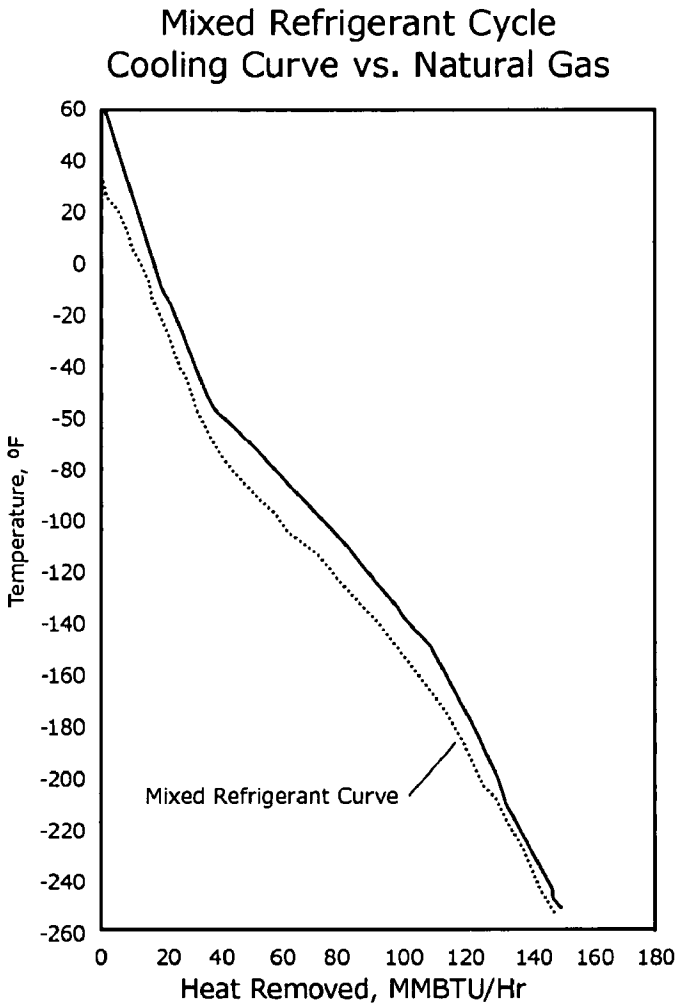
FIG. 4*a* depicts a graph showing the condensation curve of a mixed refrigerant system.
Figure 4B:
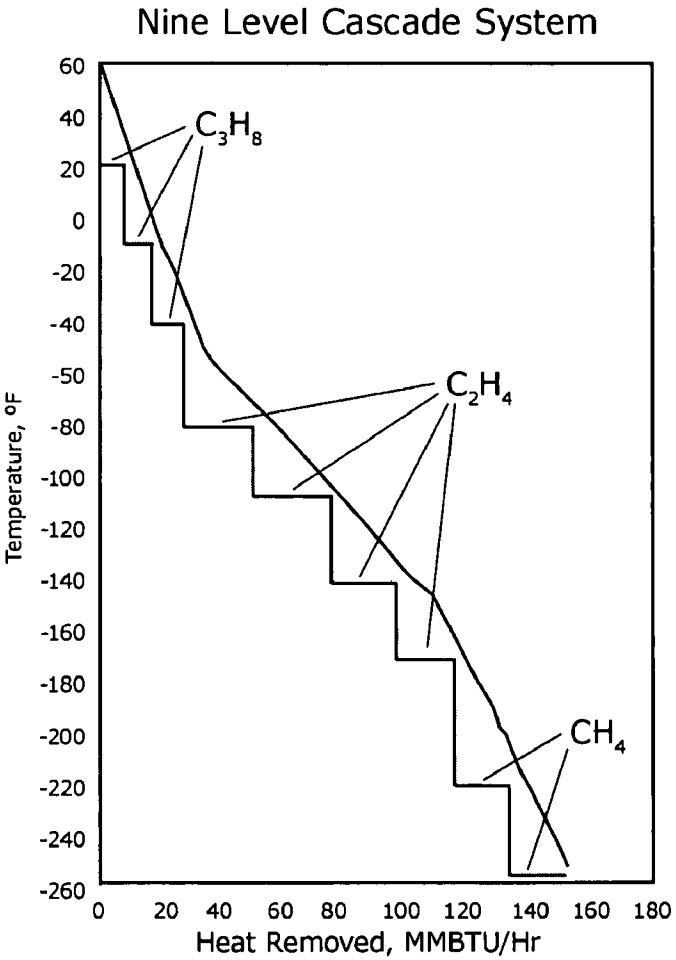
FIG. 4*b* depicts a graph showing the condensation curve of a nine level cascade pure refrigerant system.

The refrigeration circuit can extract energy from the natural gas and reject the energy to the environment. In some embodiments, one, two, or three refrigerant circuits can be used, involving pure refrigerant, mixed refrigerant and/or a combination of pure and mixed refrigerant. Base load liquefaction processes generally use mechanical refrigeration, in which heat is transferred from the natural gas through exchanger surfaces to a separate closed loop refrigerant fluid. The circulating refrigerant provides the necessary cooling. The refrigerant fluid is colder than the natural gas through compression and pressure let-down expansion. The types of refrigerant systems that can be used include pure refrigerant and mixed refrigerant (MR). One difference between pure refrigerant systems and mixed refrigerant systems is the stepwise or cascading cooling effect of pure refrigerant versus the evaporation curve of a mixed refrigerant paralleling the condensation curve of the natural gas as shown. FIG. 4*a* depicts a graph showing the condensation curve of a mixed refrigerant system. FIG. 4*b* depicts a graph showing the condensation curve of a nine level cascade pure refrigerant system. The natural gas condensation can take place in one piece of equipment with intermittent withdrawal and reentry, or in two or more exchangers in series, for example. Plate fin and spiral wound exchangers can allow several streams to be cooled in the same piece of equipment. In one embodiment, the refrigeration is accomplished by a propane pre-cooled MR process that combines the cascading effect of the pure refrigerant with a mixed refrigerant as a second cooling media. One embodiment of a method having a multi-component refrigerant combined with a cascade method is U.S. Pat. No. 4,404,008 to Rentler et al., which is incorporated by reference herein.

Figure 5:
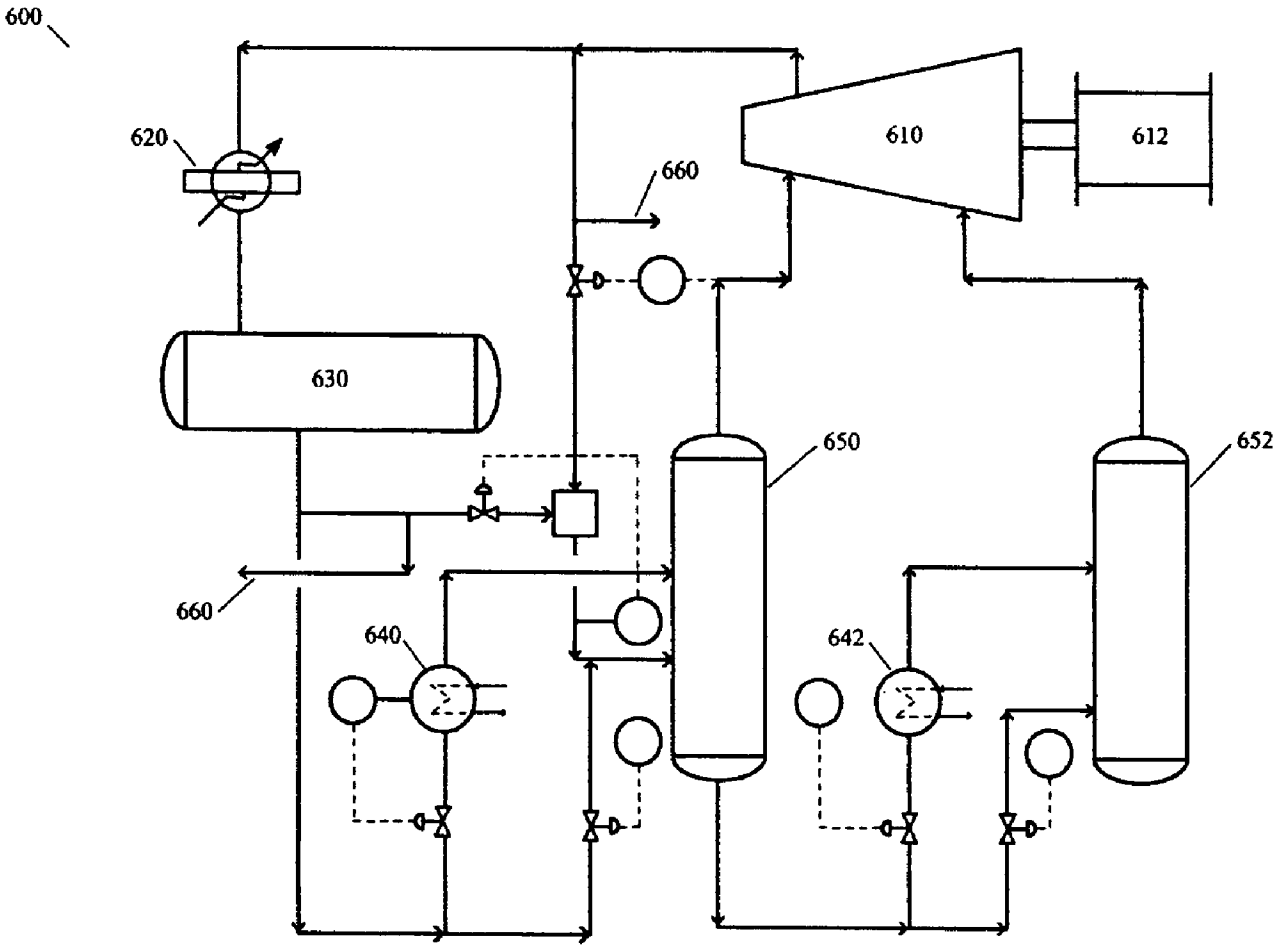
FIG. 5 depicts a schematic illustration of a conventional refrigeration system for an LNG facility.
Figure 6:
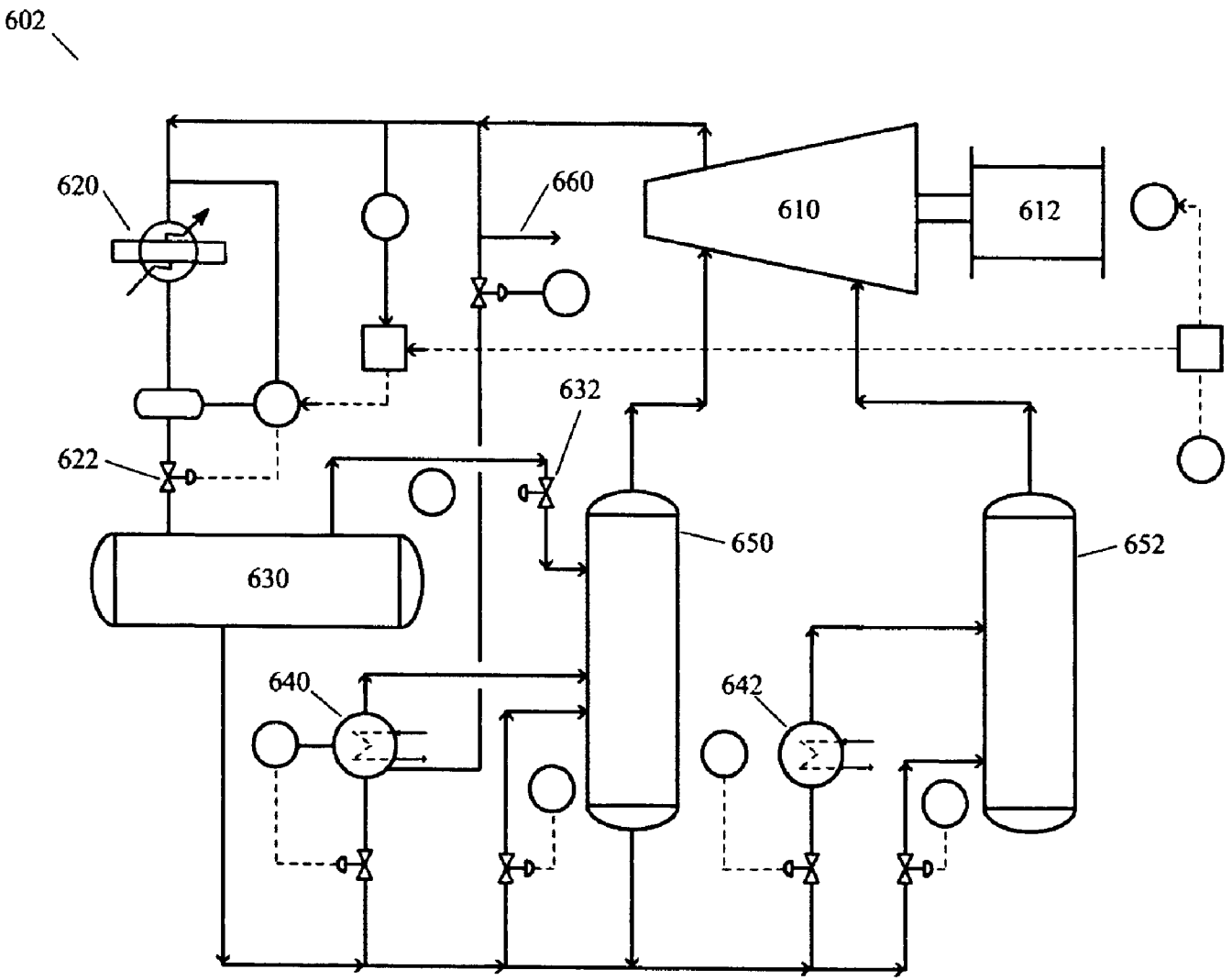
FIG. 6 depicts a schematic illustration of an alternate refrigeration system for an LNG facility.

Designing for normal steady state conditions is important but unusual operating conditions should also be considered. A few important examples are: varying cooling water (or air) temperature to the condenser; changing refrigeration load; and compressor recycle. Referring to FIGS. 5 and 6, these two systems may seem equivalent in operation and the capital cost and normal steady state operating costs of these two systems are essentially the same. The difference between the two is in how they will respond to the examples of unusual operating conditions listed above.

FIG. 5 depicts a schematic illustration of a conventional refrigeration system for an LNG facility. FIG. 6 depicts a schematic illustration of an alternate refrigeration system for an LNG facility. Both the conventional system 600 shown in FIG. 5 and the alternate system 602 shown in FIG. 6 contain the same major components of a compressor 610, compressor driver 612, desuperheater/condenser 620, accumulator 630, process heat exchangers 640, 642, suction drums 650, 652 and one or more lines 660 to enable the flow of refrigerant to other stages of refrigerant use.

Varying Cooling Medium Temperature: The cooling medium temperature to the refrigerant condenser 620 can have large variation depending on the season, weather conditions, and with air cooling the temperature changes from day to night can have a significant effect. In the conventional scheme (FIG. 5), colder cooling medium than normal results in the lowering of the compressor 610 discharge pressure due to the excess surface area in the condenser 620; to control the suction pressure above vacuum conditions, the driver 612 speed is reduced. This control scheme works quite well in most situations. However, if the cooling medium temperature variations are large, or if a driver 612 with a fixed or limited range of speed is employed, the scheme 602 shown in FIG. 6 is more suitable. In this design, a control valve 622 is installed between the condenser 620 and the refrigerant accumulator 630. The control valve 622 can flood liquid into the condenser 620 (reduce surface area) to increase the compressor 610 discharge pressure which in turn increases the suction pressure; this is especially useful with a fixed speed driver 612 because it avoids the potential for vacuum suction conditions due to a low discharge pressure.

Changing Refrigeration Load: Normally the level of refrigerant in the accumulator 630 and the compressor suction drums 650, 652 remain relatively steady, however, when the process load changes, the level in the accumulator 630 should easily respond to the varying demand for liquid required by the evaporative exchangers without causing secondary disturbances in the control scheme. The system 602 in FIG. 6 accomplishes this objective. The pressure of the accumulator 630 can be controlled at a lower pressure than the compressor 610 discharge pressure via the control valve 632 that can vent vapor from the accumulator 630 to the high level refrigerant sideload pressure (note that the control valve 622 between the condenser and the accumulator, as discussed in the previous section, is also necessary in order to "decouple" the compressor 610 discharging pressures from the accumulator 630 operating pressures). Thus, with the ability to vary the vapor generation in the accumulator 630, the level in the accumulator 630 is easily varied without disturbances to the compressor 610 operation. With the scheme of FIG. 6, the accumulator 630 can then more easily accomplish its main function—intermediate storage of liquid inventory that responds readily to refrigeration demand.

Compressor Recycle: When the compressor 610 is in recycle operation, the compression energy must be removed by the desuperheater/condenser 620 to avoid temperature build-up in the refrigeration system. In many refrigeration systems, such as 602 shown in FIG. 6, the liquid formed in the condenser 620 is directly injected into the vapor recycle (desuperheating) at each stage to maintain the proper temperature at that refrigeration stage. This method works very well under many operating conditions. The primary shortcoming, however, is that due to either poor temperature control or the limited desuperheater operating range, too much liquid may be injected at one or all stages and result in excessive liquid accumulation at the lower level compressor suction drum 652 or exchangers 640, 642. This problem can be resolved by the direct injection/sparging of the recycle vapor via control valve 632 into either the drum 650 or evaporative exchanger 640 as shown in FIG. 6. This system is operable throughout the entire recycle range possible with the compressor 610 and is more reliable and predictable. Note that in general, the preferred method of sparging is into the exchanger 640 if possible because sparging into the compressor suction drum 650 increases the drum size and creates undesirable frothing. Sparging into the heat exchanger 640 more easily handles these concerns. An interesting design detail is the exact placement of the vapor injection control valve 632. If the valve 632 is located too far from the drum/exchanger 650/640, there is a significant liquid piping inventory on the downstream side of the valve. When the recycle begins, the liquid piping inventory is forced into the drum/exchanger 650/640 creating a sudden undesirable level rise. The obvious solution is to design the system to minimize the liquid inventory between the control valve 632 and the drum/exchanger 650/640.

Another solution to the problem of compressor recycle and liquid inventory control is the use of vapor recycle (without liquid cooling of the vapor). The heat of compression is removed via a desuperheater on the compressor discharge. This solution avoids concerns about liquid inventory and liquid carryover to the compressor because refrigerant liquid cooling is not employed. The primary disadvantage of this scheme, however, is that during the recycle operation, the compressor sideload temperature rises above the normal operating temperature; but this system is acceptable since the compressor can be designed for the full range of operation.

Compressors and Drivers

Reducing the number of machines per train while increasing the train capacity is the subject of considerable investigation. A recent development, associated with high capacity LNG trains, involves the use of large gas turbines to drive multiple refrigerant compressors connected in tandem on a single shaft. The large gas turbines can require a starter, which can be utilized for other duties when not used as a starter and in some instances have been used as power generation units. The starter can be used to supplement the power of the gas turbine during normal operation if desired. Other possible configurations include: a combined cycle where waste heat recovery from gas turbine(s) generates steam utilized by a steam turbine driving another compressor; large electric motor drivers associated with inexpensive hydroelectric power or as part of a specific power plan development project; and/or the use of available pressure in the feed gas stream to drive an expander and isentropically lower the temperature of the feed using the power from the expander to supplement the refrigeration systems.

Liquefaction Processes

The following is a representative listing of liquefaction processes that have been developed: APCI Propane precooled mixed refrigerant, C3MR, DUAL MR; Phillips Optimized Cascade; Prico single mixed refrigerant; TEAL dual pressure mixed refrigerant; Linde/Statoil multi fluid cascade; Axens dual mixed refrigerant, DMR; and Shell processes C3MR and DMR.

Heat Transfer Equipment

Shell and Tube Units: The main use of shell and tube type exchangers in LNG plants is for cooling water service and for boiling refrigerant services down to temperature levels of −50° F. Below a temperature of −50° F., alloy construction such as nickel alloys, for example 3.5% and 9% nickel, stainless steel, or aluminum is required. It is seldom that the shell and tube exchanger remains competitive when temperatures are colder than −50° F. when a large number of HTU are required. The significant savings in exchanger surfaces permit a reduction in hardware, making these units economical.

Aluminum core (plate-fin) exchangers: The plate-fin exchanger is typically made up of heat exchange surfaces obtained by stacking alternate layers of corrugated, die-formed aluminum sheets (termed fins) between flat aluminum "separator" plates which can vary in thickness from 0.032 to 0.064 inches, depending on design pressure. The separator sheets supply the primary surface and the fins supply the secondary, extended surface. In normal design practice, the secondary surface varies from 67% to 88% of the total heat transfer surface provided in an exchanger. Each layer is closed at the edges with solid aluminum bars of appropriate shape and size. A full size heat exchange is made by stacking many layers, one on top of the other. This multi-layer stack is then bonded together by a carefully controlled vacuum brazing process to yield an integral rigid structure with a series of fluid flow passages.

The dimensions of the corrugated aluminum sheets (fins), which actually form the fluid passages and provide the extended heat exchange surfaces, can be varied widely with respect to quantity, shape, spacing size and type, dependent upon both thermal and hydraulic design as well as manufacturing economy. Fins are normally furnished with straight corrugations in "plain", "perforated" or "lanced" configurations. Fin height can he varied from 0.200 to 0.355 in., metal thickness from 0.008 to 0.025 in., and fin density from 6 to 25 fins/in. The actual selection of the most suitable fins for any particular application is therefore, dependent upon the maximum working pressure, plus other variables such as heat exchange rates, allowable pressure drops, fluid properties, and fluid flow rates. Each of the several different fluids being handled simultaneously in a given exchanger is accordingly assigned a certain passage geometry also based on a careful optimization of calculated thermal and hydraulic performance. Then the different passage geometries are stacked up similar to a sandwich, alternating symmetrically into one of the several flow patterns available. The most common of these used in process plants is the counter flow pattern gas-to-gas and liquid-to-gas.

Boiling or condensing applications often use a cross-flow pattern that minimizes pressure drop in the exchanger, an important process consideration in the boiling stream. Following the brazing and cleaning of the exchanger core, the collectors and nozzles can then be welded onto the unit. Then, a pneumatic test of at least 110% of the design pressure and/or hydrostatic pressure test of at least 130% of the design pressure is typically applied. Brazed aluminum heat exchangers usually comply with the ASME Pressure Vessel Code and are usually so certified. Plate-fin exchangers are most useful in complex process cycles because it is possible to accomplish within a single exchanger unit the same heat exchange that would ordinarily require multiple two-passage shell and tube exchangers.

Plate-fin exchangers can easily be designed to process five or six streams and it is possible to withdraw and add streams as required along the length of the heat exchanger. This feature makes it possible to accomplish a partial condensation of a feed stream within the heat exchanger, then remove the feed stream, separate the liquid and re-introduce the vapor back into the exchanger for additional condensation. There is great flexibility offered to designers by using plate-fin exchangers. Plate-fin exchangers are normally considered for operation in processes that are non-corrosive to aluminum, non-fouling, and free of particles that could plug fin spacing of 15 or 16 fins/in. Most cryogenic processes meet these criteria. Because most warm feed streams are coming from a pipeline, it is considered a wise precaution to use filters or strainers before entering a plate-fin exchanger. Even traces of compressor oil may build up on the fin surface over long periods of time and foul or plug the exchanger.

The size of individual cores is dependent on fabrication facilities and operating conditions, primarily pressure. The size of the brazing furnace and the ability to evenly distribute heat during the brazing process sets maximum limitation with respect to the size of cores. The exchangers can be, for example 4 ft.×4 ft.×20 ft. long with heat exchange surfaces approaching or exceeding 100,000 sq. ft. per core. Since individual cores have to withstand the full design pressure of individual streams and also have to pass the pressure test, fabricated core sizes must be reduced with increasing design pressures. Generally, maximum sizes at design pressure of approximately 650 psig are 3 ft.×3 ft.×16 ft. and the heat exchange surfaces per core are generally limited to approximately 40,000 sq. ft.

For liquefaction plants, considerably more heat exchange surface is required than can be supplied by a single core and, therefore, it becomes necessary to combine a large number of cores requiring extensive manifolding. A typical unit processing 300 million std. cu. ft./day may require 30 to 40 cores, dependent on process conditions. Ensuring somewhat equal flow through each core can be a significant challenge. These manifolded core assemblies are generally located within a cold box together with other equipment and piping as part of the low temperature process section. In order to avoid extensive field assembly, involving aluminum welding, complex fit-ups, etc., core assemblies may be shipped to a seaside assembly point where the final construction and assembly of the cold boxes can be performed. These assembled cold boxes (excluding insulation) may then be shipped as a unit by barges or other suitable water transportation means. The cost for manifolding, cold box fabrication, and assembly is significant and may more than double the cost of the actual cores. Nevertheless, the overall installed cost of such a unit is competitive with other types of cryogenic exchangers.

Spiral Wound Exchangers: The spiral wound heat exchanger as the name implies, is made up of tubes which are wound on a mandrel, as thread or cable is wound on a spool. The exchanger will have a tube sheet at either end to which each tube is joined. Normally, a layer of tubes is wound (say left to right) on a mandrel, and spacers (bars, wire, etc.) attached to the tube. This is followed by a second layer wound in the opposite direction (right to left), and then a third (left to right again), each layer complete with its own set of spacers. This procedure is repeated until the required number of tubes has been wound onto the mandrel. For the large exchangers used in LNG plants, tubing diameter will usually range from ⅜ to ¾ inch in diameter. These tubes, which can range from 75 to 150 feet in length, can be applied to the mandrel with a winding angle or helix of approximately 10°. This means that a layer of ½ in. tubes at 5 ft. diameter with a pitch of 0.75 in. will consist of 40 parallel tubes, while a layer at 10 ft. diameter would consist of 80 parallel tubes.

The tube winding is generally been performed on gigantic lathes. As bundle sizes increased, additional temporary supports can be used to minimize the deflection of the mandrel due to the bundle weight causing detrimental movements between tubes and spacers during the winding operation. The winding can also be performed in the vertical position, thereby minimizing the weight effect of the bundle. The tubes can be made of aluminum or copper or possibly other materials. When using aluminum tubing, aluminum tube sheets and shells are generally used, although, in some cases, it may be more economical to use stainless tube sheets and shells with aluminum tubes.

By using more than one tube sheet at either end it is possible for these exchangers to handle more than one fluid in the tubes. By using a very long mandrel, it is possible to wind several exchangers on a single mandrel and enclose them all in a single shell. This feature is particularly useful when the process employs the same shell side fluid for several exchangers in series because this feature greatly reduces the need for field construction labor. Generally, the LNG spiral wound exchanger units are mounted vertically with the cold section at the top. The high pressure streams are inside the tubes. The vaporizing low pressure refrigerant flows downward in the shell side. Although the technology for fabricating spiral wound exchangers is well known, the advent of large LNG plants has dramatically increased the available sizes for this type of exchanger. Individual preferences, process or site conditions, or economics may dictate the use of one or the other of the exchanger types mentioned above.

Since most exchanger applications within the cryogenic section involve boiling and condensing, the specific hydraulic problems of two-phase flow require special attention with respect to flow direction, distribution, and mixing. These requirements may favor some exchanger types or may require special design details. It is not practical to reach general conclusions with respect to optimum selections. Heat exchanger requirements for each sending terminal can be extensive and regardless of which type exchanger is being selected, a major strain can be put on the available worldwide fabrication facilities which may have a significant effect on the delivery schedule. This is particularly true if several large LNG plants are being considered at the same time. Since these exchangers are not solely used for LNG terminals, but are also specified for any other low temperature process, their availability is dependent on the overall demand of cryogenic plants. New concepts in either design or fabrication, with particular emphasis on extremely large units, most likely being fabricated of aluminum are therefore desired.

Liquefaction Pump Services

Examples of major pump services in the liquefaction unit includes: Amine circulation (acid gas removal process); Reflux for scrub column and fractionation towers (liquefaction process); LNG product pumps; Seawater pumps (if seawater cooled); and Hot Oil Pumps.

Amine Pumps: The amine pumping service is often split into two parts: a low head pump working at high temperature followed by a high head pump operating at near-ambient temperature. Using the low head booster pump at the high temperature avoids problems with cavitation within the pump which would be present if the high head pumping were done at high temperature. The booster pump is typically a single stage double section pump with low NPSH (Net Positive Suction Head) requirements. By using a pump with low NPSH requirements for the booster pump, the residual dissolved $CO_2$ remains in solution. When $CO_2$ is allowed to come out of solution, a phenomenon similar to cavitation occurs that is potentially very damaging to the pumps. To avoid the potential for cavitation damage, calculated NPSH available numbers are typically reduced by three to four times to provide sufficient actual margin. The amine circulation rate depends on the amount of acid gas, but a train making 5 MMTPA of LNG with a natural gas feed containing 15% $CO_2$ can have a circulation rate over 2000 cubic meters/hour handled with 3×50% pumps. The high-head circulation pumps are typically multi-stage, between bearing, horizontal designs driven by electric motors.

Reflux Pumps: The reflux pumps for the scrub column operate at about −30° C. to −50° C., and in the fractionation unit the deethanizer reflux pumps also operate at about −30° C. The flow rates of these pumps depend to a large extent on the natural gas composition. For a 5 MMTPA train handling associated gas the scrub column reflux flow can be in the 350 to 400 cubic meters/hour range, though a plant processing non-associated gas usually has a smaller scrub column reflux pump. The scrub column reflux pump size depends to a great extent on the aromatics present, but in some cases where the natural gas contains little ethane and propane, recovering refrigerant components can be the main factor that determines reflux pump size. These pumps are normally single stage.

LNG Product Pumps: The LNG product pump has a special design for cryogenic service. The pump is a submerged motor, "pot mounted" pump for these applications. The container, flooded with LNG during operation, also contains the motor. The suction of the pump is at the bottom of the container, and the LNG discharge flows through the motor thus providing cooling for the motor. This arrangement does require cryogenic rotating seals; the only seal needed is for the electrical connection box, and the box is always purged with nitrogen to prevent natural gas leakage through the conduit. LNG Product Pumps has at least the following advantages over conventional sealed pumps: (i) the LNG Product Pump is completely submerged in the pumped fluid, resulting in reduced noise; (ii) the LNG Product Pump does not contain rotating shaft seals that are difficult to design and maintain for the cryogenic temperatures; therefore, inflammable gas is not leaked into the atmosphere (the pump does have static seals in the electrical conduits to seal around the main power supply and instrumentation wiring); (iii) the LNG Product Pump uses a single shaft design with both the pump impellers and motor on the same shaft, eliminating the need for a coupling and removing alignment issues; (iv) the LNG Product Pump motor and pump bearings are product lubricated, eliminating the need for an external lube oil system; and (v) the LNG Product Pump does not require an explosion proof motor.

As an operational and design challenges for a submerged motor LNG pump, the suction pot of the pump must be liquid filled prior to starting the pump. Cool down of the pump is a delicate activity that must be done slowly to prevent excessive thermal stresses and damage within the pump. Various methods are used to try and ensure that the pump is properly cooled down and liquid filled prior to start-up. These include monitoring the temperature on a vent/bleed connection to the pump, use of temperature sensors within the pump suction container and a level gauge on the suction pot. Further, in a cryogenic application, condition monitoring is difficult since the vibration monitors need to be placed inside the cryogenic suction pot mounted on the pump. Some other options that have been used are external vibration instruments on the cover plate of the suction pot and operating without vibration instrumentation. The LNG Product Pumps have historically been very reliable, therefore for many users, operation without condition monitoring instrumentation has been an acceptable solution.

Seawater Cooling vs. Freshwater Loop Cooling: The seawater pumps are very large in a base load LNG plant and the pumps are typically mounted vertically in a seawater intake basin. The flow rates of these pumps are commonly in the 15,000 to 18,000 $m^3$/hr range. The head may vary between 50 to 60 meters. Large, vertical, open pit, multi-stage pumps are commonly used. In some plants the seawater removes heat from a fresh water loop, instead of the more common once-through cooling where the seawater goes directly through heat exchangers and then discharges back to the sea. The fresh water loop circulation rate is similar to the seawater rate, but the liquefaction unit exchangers exchange heat with fresh water. The advantage of using the extra cooling loop is higher reliability and lower cost materials in the liquefaction unit. The disadvantages are extra cost and equipment for the fresh water loop and a higher heat sink temperature for the process (which makes the process require more energy). Fresh water circulation pumps are normally horizontal, double suction designs.

Hot Oil Pumps: The liquefaction process, in spite of being cryogenic, still requires some heating services. Examples are the amine stripper reboiler and fractionation reboilers. However, most gas turbine driven LNG plants do not have heat recovery steam generation (HRSG), and in such cases hot oil is a common heat transfer medium. The hot oil is circulated between the heat source and process services with hot oil pumps. In some cases, steam is used as a heating medium, and in such cases condensate pumps and boiler feed water pumps replace the hot oil pump services. This substitution commonly takes place when there are enough sulfur compounds in the gas to make sulfur recovery in a Claus unit necessary; the Claus unit generates low pressure steam which is available for process heating services. Another option that has been successfully used is to incorporate a waste heat recovery unit in the exhaust of the gas turbine and utilize a heated water circuit for heating. The heated water system is maintained under pressure to prevent boiling, and a centrifugal pump is used for circulation. Hot oil and hot water circulation pumps can vary widely in design, but horizontal double suction designs are commonly used. Hot oil pumps typically have a capacity between 1500-2000 cubic meters/hour, and a head between 120-140 meters. Heated water pumps typically have a capacity between 750-1250 cubic meters/hour, and a head of 220-250 meters; water has a higher heat capacity than oil, hence circulation rates tend to be smaller.

Cryogenic Liquid Expanders: One other service in liquefaction related to pumps is the cryogenic liquid expander as an alternative to a JT (Joule Thompson) valve. The liquid expander (or hydraulic turbine) is like a pump running in reverse; the fluid enters at high pressure and exits at lower pressure, and shaft power is generated instead of being consumed. The drop in pressure is controlled with a back-pressure valve to prevent the discharge from flashing into two phases. Two different technologies have been used for the cryogenic liquid expander application. The first is a submerged motor LNG pump operating as a liquid turbine. For this design, the expander/generator speed is controlled by using a Variable Speed Drive System (VSDS). This design has the advantages of the mechanical portions of the LNG cryogenic pumps, i.e. no seals and couplings. The second approach is to use a liquid expander similar to a vertical turbine pump. This technology requires the use of a shaft seal (either dry gas or oil film) and an external generator. The performance of the turbine is controlled using a set of wicket gates (inlet guide vanes) to control the pressure drop across the expander. The speed of the expander is fixed with the synchronous generator connected to the electrical grid.

Figure 7:
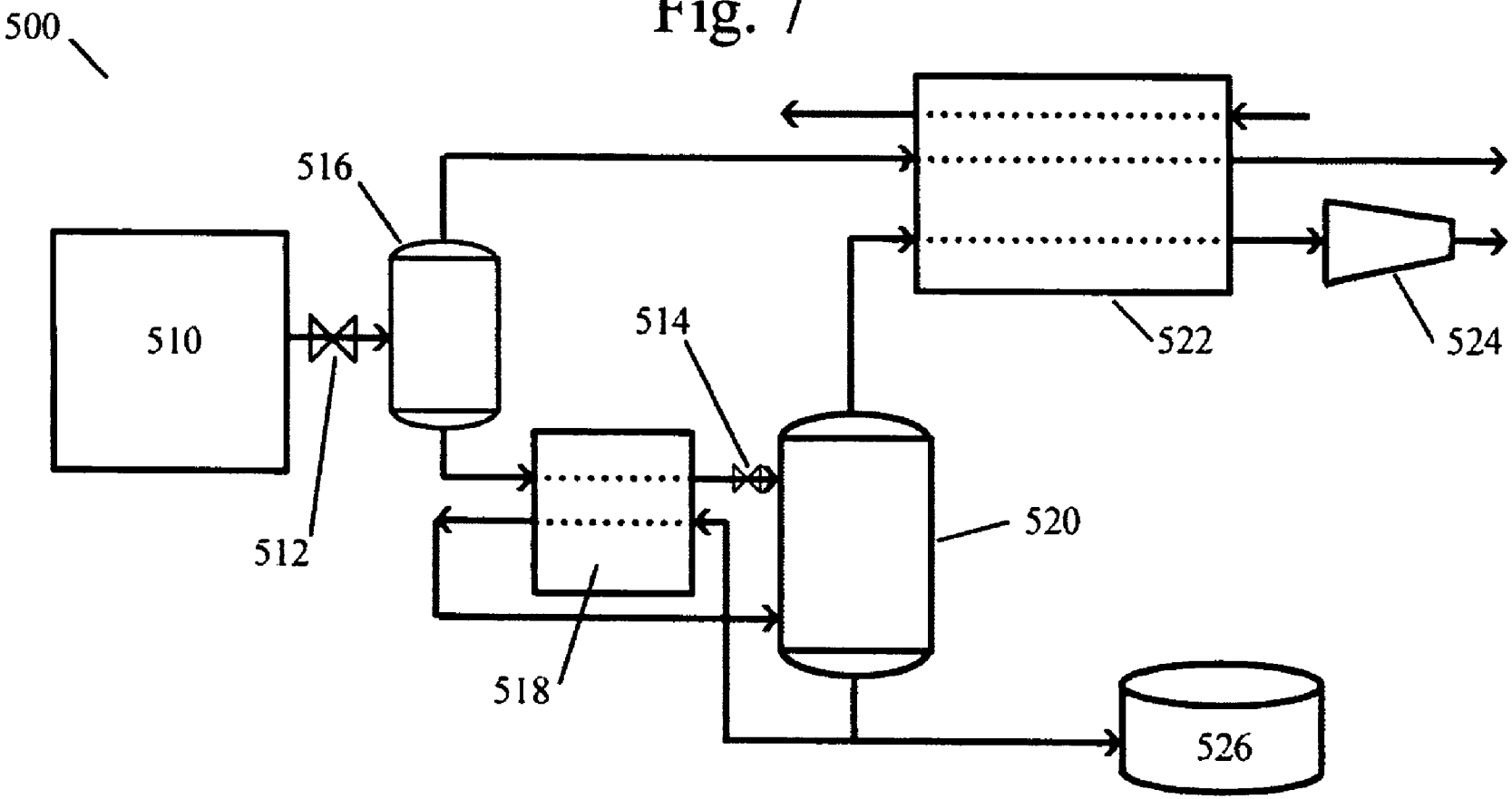
FIG. 7 depicts a schematic illustration of one embodiment of an endflash unit for nitrogen rejection.

Nitrogen Rejection (Endflash): FIG. 7 depicts a schematic illustration of one embodiment of an endflash unit for nitrogen rejection. In FIG. 7, illustrating one possible embodiment, the endflash section 500 can remove nitrogen from the LNG. After liquefaction of the natural gas at high pressure in the liquefaction section 510, the LNG pressure can be reduced, such as through one or more valves 512, 514 to approximately atmospheric pressure before entering the storage tanks 526. This eliminates high vapor generation in the tank that would have to be recompressed by a boil off gas compressor, utilized as fuel, flared, or otherwise utilized. An endflash 500 can be used if the nitrogen content in the LNG is above about 1%. The endflash 500 also can remove methane with the nitrogen that can be returned to the fuel gas system by re-pressurizing the gas to a fuel gas pressure. The endflash section 500 can comprise a flash drum 516 and/or a re-boiled, trayed column 520 for more extensive nitrogen removal. The column 520 can concentrate the nitrogen and reduce the methane loss from the LNG. The vapor can be routed through an exchanger 522 to recover most of the cold energy before being compressed in the fuel gas compressor 524. Column 520 can also be a flash drum instead of a trayed column, in which case the exchanger 518 may be eliminated.

Fuel Gas System

The fuel gas system receives supply from the feed gas, flash gas at the back end of the liquefaction train, storage and loading area, and miscellaneous sources such as the fractionation area, etc. To minimize the overall power requirements for liquefaction, the flash gas system provides the majority of the fuel gas requirements for the plant. If the flash gas compressor trips off, fuel make-up is from the feed. This system operates well as long as the heating value of the feed and the flash gas are close. However, in plant designs containing a significant amount of nitrogen in the feed, the flash gas also contains significant nitrogen; for example, 5% nitrogen in the feed gas results in about 40% nitrogen in a typical flash gas system. The primary concern is that the flash gas and the feed gas are not immediately interchangeable at the feed users (heaters, boilers, etc.).

Figure 8:
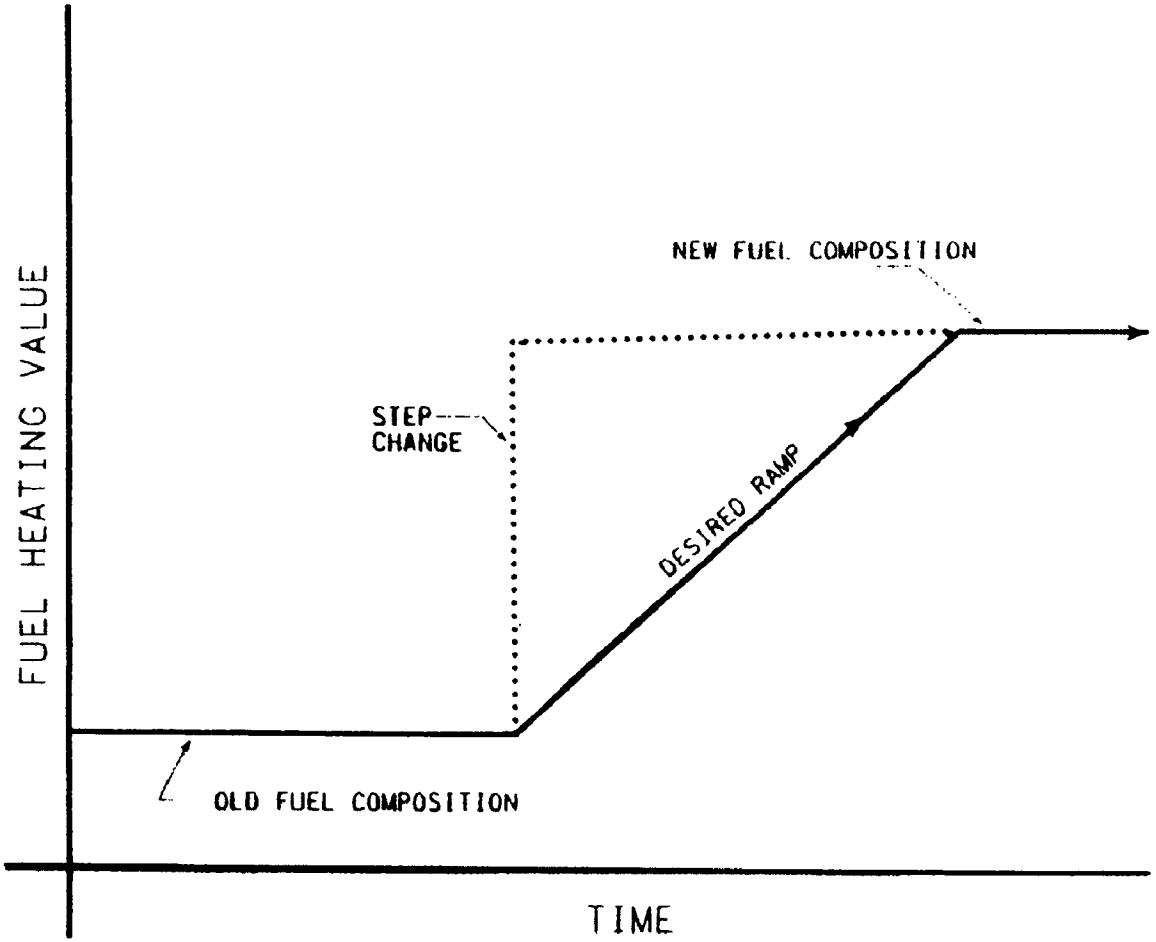
FIG. 8 is a graph illustrating the changing heating value of fuel gas in a step change and a ramping change.
Figure 9:
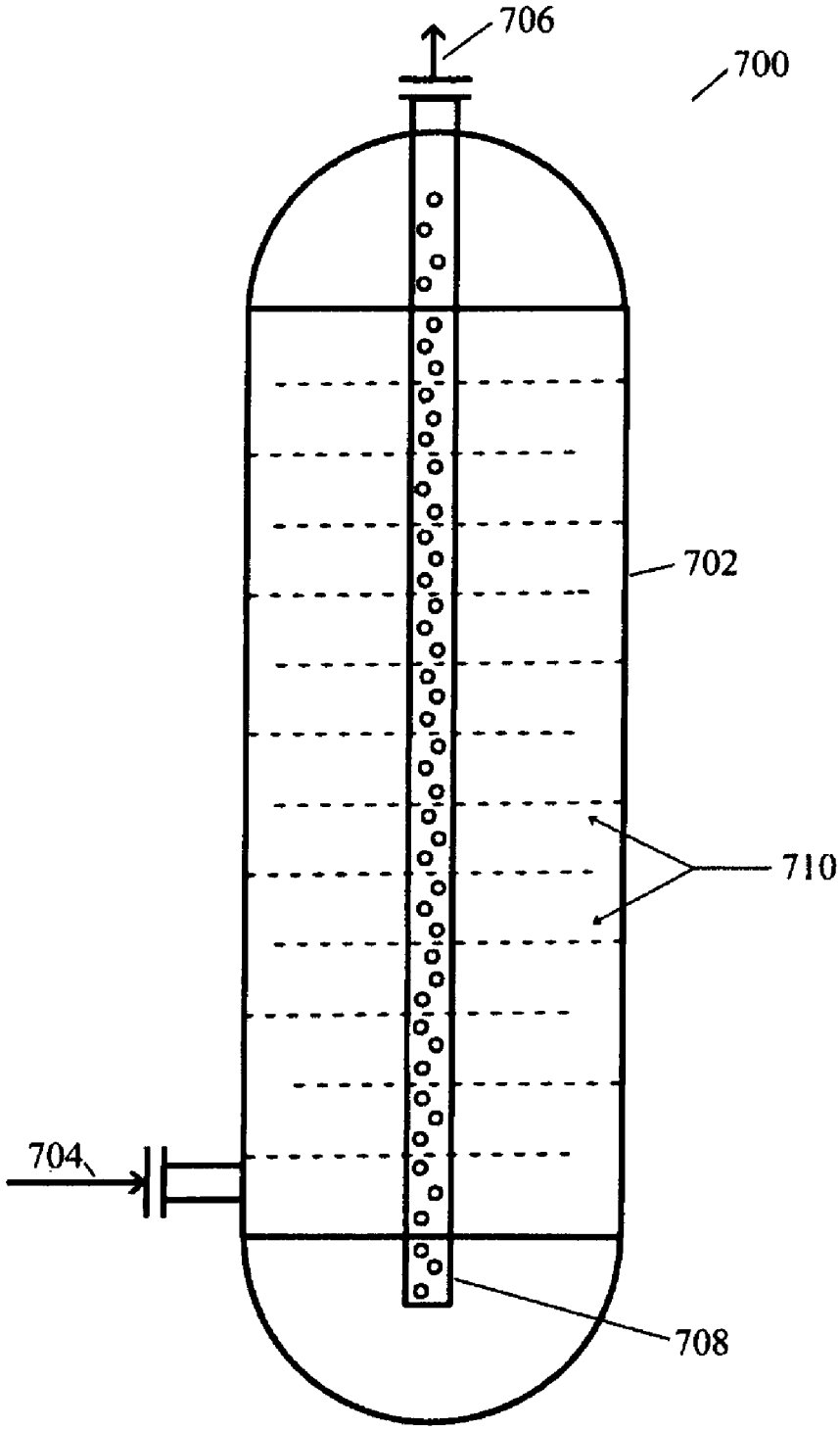
FIG. 9 depicts a schematic illustration of one embodiment of a mixing vessel to control heating value changes in fuel gas.

A system can be designed to "ramp" the change in heating value from predominantly flash gas to all feed gas so that the fuel burner controls at the users can be adjusted at a reasonable rate; without an appropriate system, the heating value change to the user could be essentially a step change (see FIG. 8). FIG. 8 is a graph illustrating the changing heating value of fuel gas in a step change and a ramping change. One method to accomplish this ramping of heating value uses a fuel gas mixing system that is capable of controlling the rate of change to a manageable level (for example, 20% to 30% change per minute) as shown in the desired ramp in fuel heating value in FIG. 8. FIG. 9 depicts a schematic illustration of one embodiment of a mixing vessel to control heating value changes in fuel gas. FIG. 9 depicts one embodiment of a fuel gas mixing system 700 providing a linear ramping of the heating value and includes a mixing vessel 702 with a fuel inlet 704, and fuel outlet 706, internals such as a center tube 708 for an exit stream connected to the fuel outlet 706 and baffling 710 to create multiple chambers within the vessel 702. Many liquefaction plants do not need such a mixing system since the heating value differences between the flash gas and the feed gas do not require ramping. Other solutions may also be possible, such as for example, heating value measurement combined with feed forward control on the boiler alone or in combination with a fuel gas mixing system may be feasible on some projects, depending upon the circumstances.

LNG Storage

An important item in LNG facilities is LNG storage. In some embodiments, in order to minimize cost, it can be useful to maximize the size of each LNG storage tank. Described below are a few types of storage tanks. Use of higher pressure storage tanks can eliminate use of blowers for vapor control. Careful layout design can also reduce piping costs. The use of large, below ground tanks may offer a more economic solution where plot space is limited. The storage tanks are equipped with relief valves as a defense against overpressure. Vacuum breakers can provide protection against external overpressure.

Single Containment Systems

Figure 10:
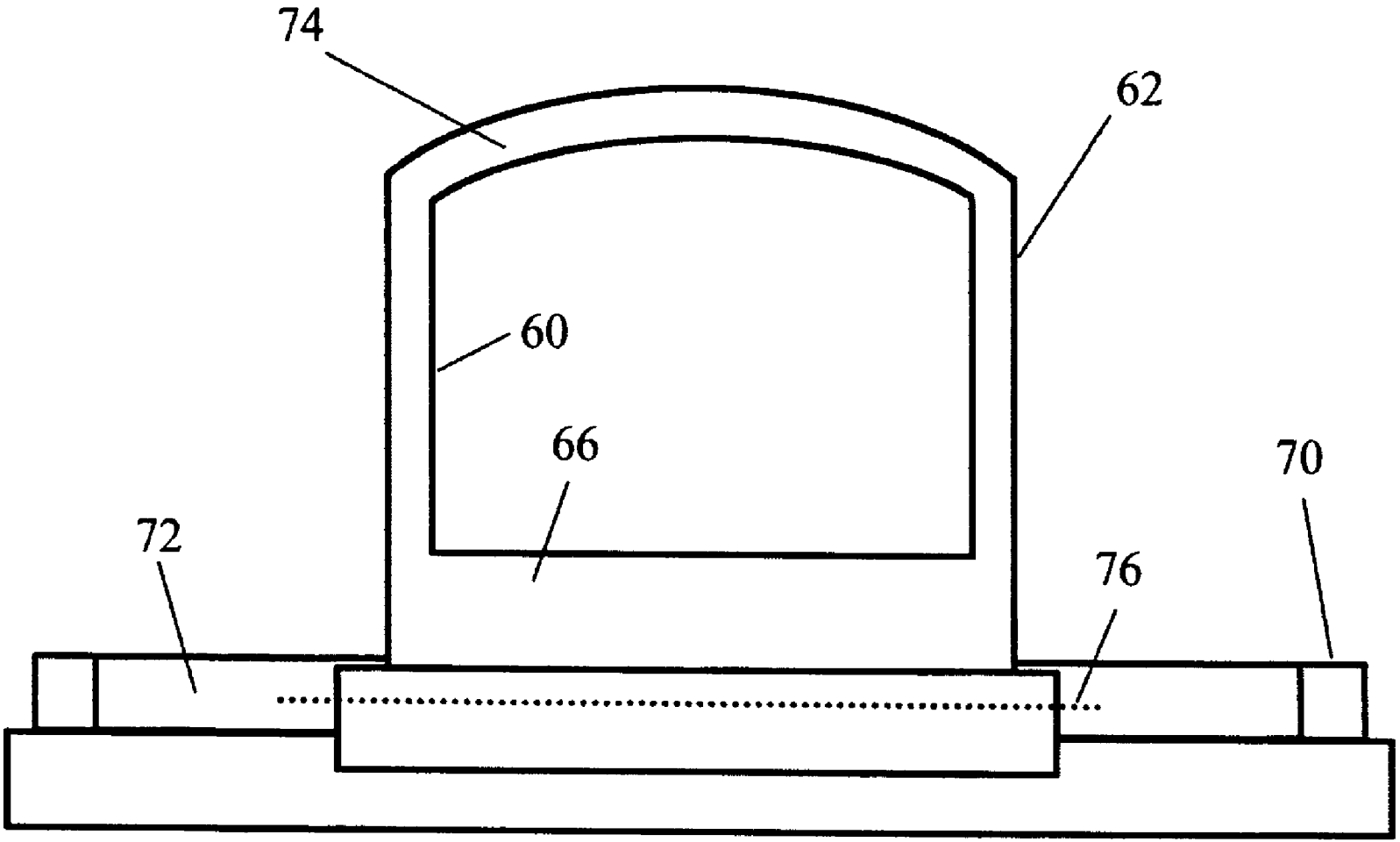
FIG. 10 depicts two illustrated examples of single containment LNG storage tanks.

FIG. 10 depicts two illustrated examples of single containment LNG storage tanks. In FIG. 10, the inner wall or primary container 60 of the single containment tank can be constructed of a material, such as a 9% nickel steel, which can contain the refrigerated liquid and can be self-supporting. This inner tank can be surrounded by an outer wall 62 which can be of a different material, such as carbon steel, that can hold insulation, such as perlite, in the annular space between the inner and outer walls 64. A carbon steel outer tank 62 is not capable of containing LNG, thus the only containment is that provided by the inner tank 60. The base can have insulation 66 and some embodiments can have a suspended deck roof 68 that can also be insulated. Single containment tanks are surrounded by a dike 70 or containment basin external to the tank, either of which provide secondary containment 72 in the event of failure or leakage of the LNG. Embodiments can have external insulation 74 and can have bottom heating 76 to prevent freezing the ground and causing heaving. In some embodiments the tanks can be elevated above grade, such as utilizing an elevated concrete raft structure, which can provide additional room for spill containment and eliminate the need for bottom heating.

Double Containment Systems

Figure 11:
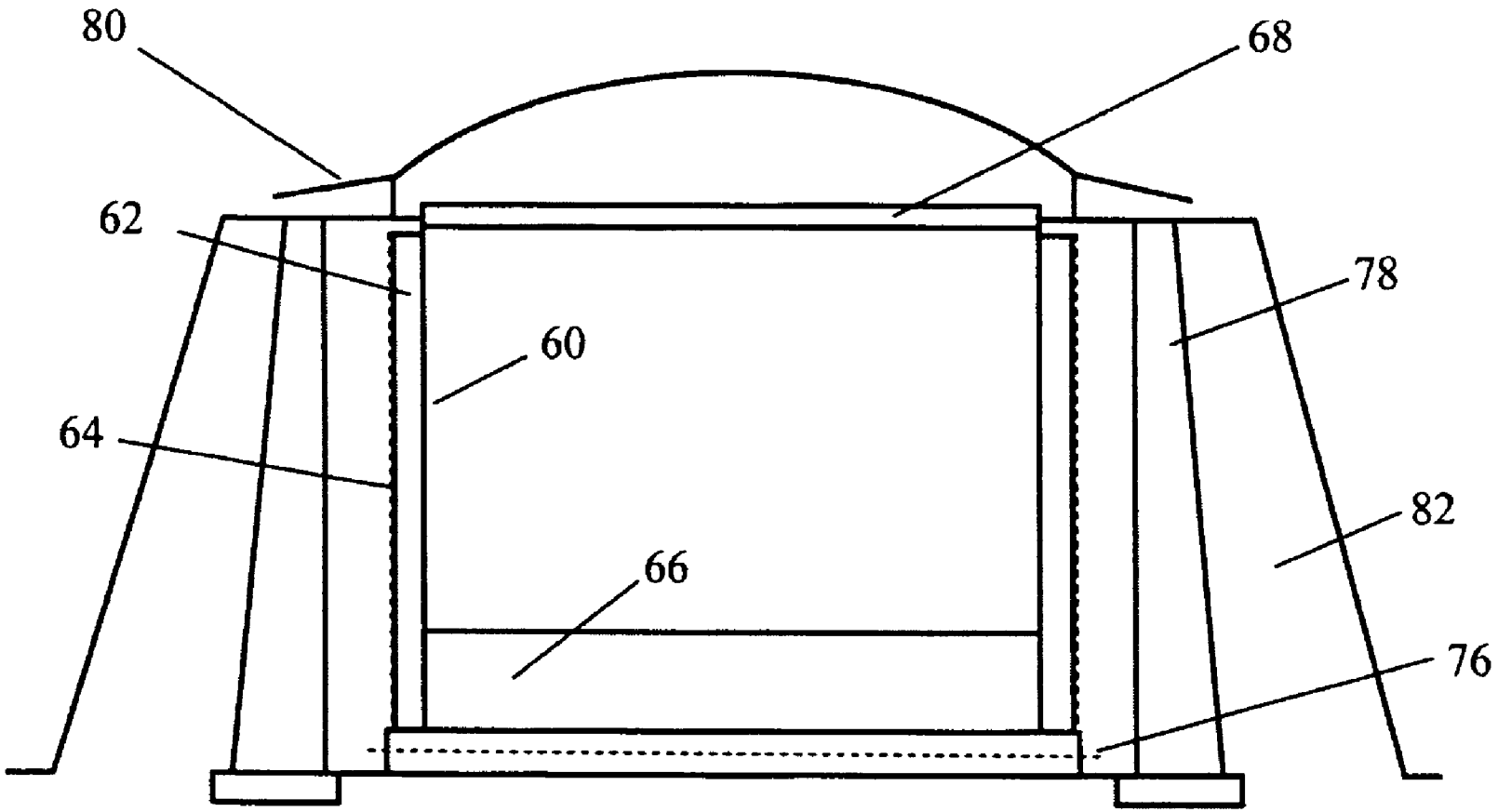
FIG. 11 depicts two illustrated examples of double containment LNG storage tanks.

FIG. 11 depicts two illustrated examples of double containment LNG storage tanks. In FIG. 11, double Containment systems include a secondary wall 78 that is capable of containing both liquid and vapor. The inner wall 60 can be constructed of a material, such as 9% nickel steel, which can contain the refrigerated liquid and can be self-supporting. The roof 68 over the inner tank can be carbon steel. Double containment tanks have an outer wall 78, such as a steel or concrete wall, capable of holding LNG. In Double Containment systems no dike is needed because the outer wall provides the secondary containment for the LNG. LNG vapors, however, may be released in the event of an inner tank leak in systems where there is no sealed roof to the outer wall. A roof 80 that is not sealed to the outer wall 78 can be provided and an earth embankment 82 can be placed exterior to the outer wall 78.

Full Containment Systems

Figure 12:
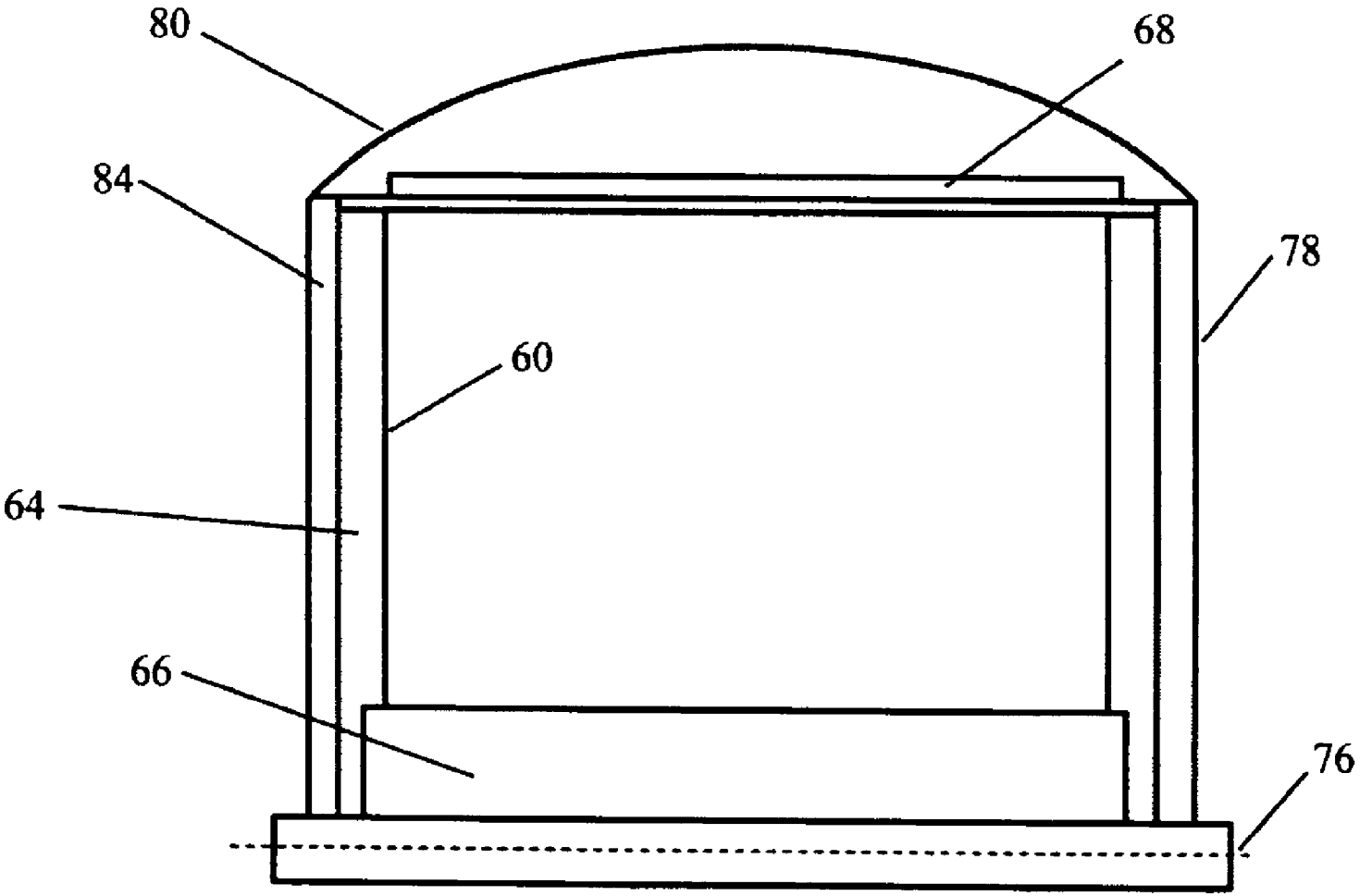
FIG. 12 depicts two illustrated examples of full containment LNG storage tanks.

FIG. 12 depicts two illustrated examples of full containment LNG storage tanks. In FIG. 12, a Full Containment system includes a secondary wall 78 that is capable of containing both liquid and vapor that has roof 80 over the outer wall, such as a concrete or steel roof, making the outer tank capable of handling both LNG liquid and vapor. The inner wall 60 can be constructed of a material, such as a 9% nickel steel, which can contain the refrigerated liquid and be self-supporting. The roof 68 over the inner tank 60 can be carbon steel. If the inner tank leaks, all liquids and vapors can still be contained within the outer wall 78 and roof 80. There can be insulation 84 on the inside of the secondary wall 78.

Membrane Systems

Figure 13:
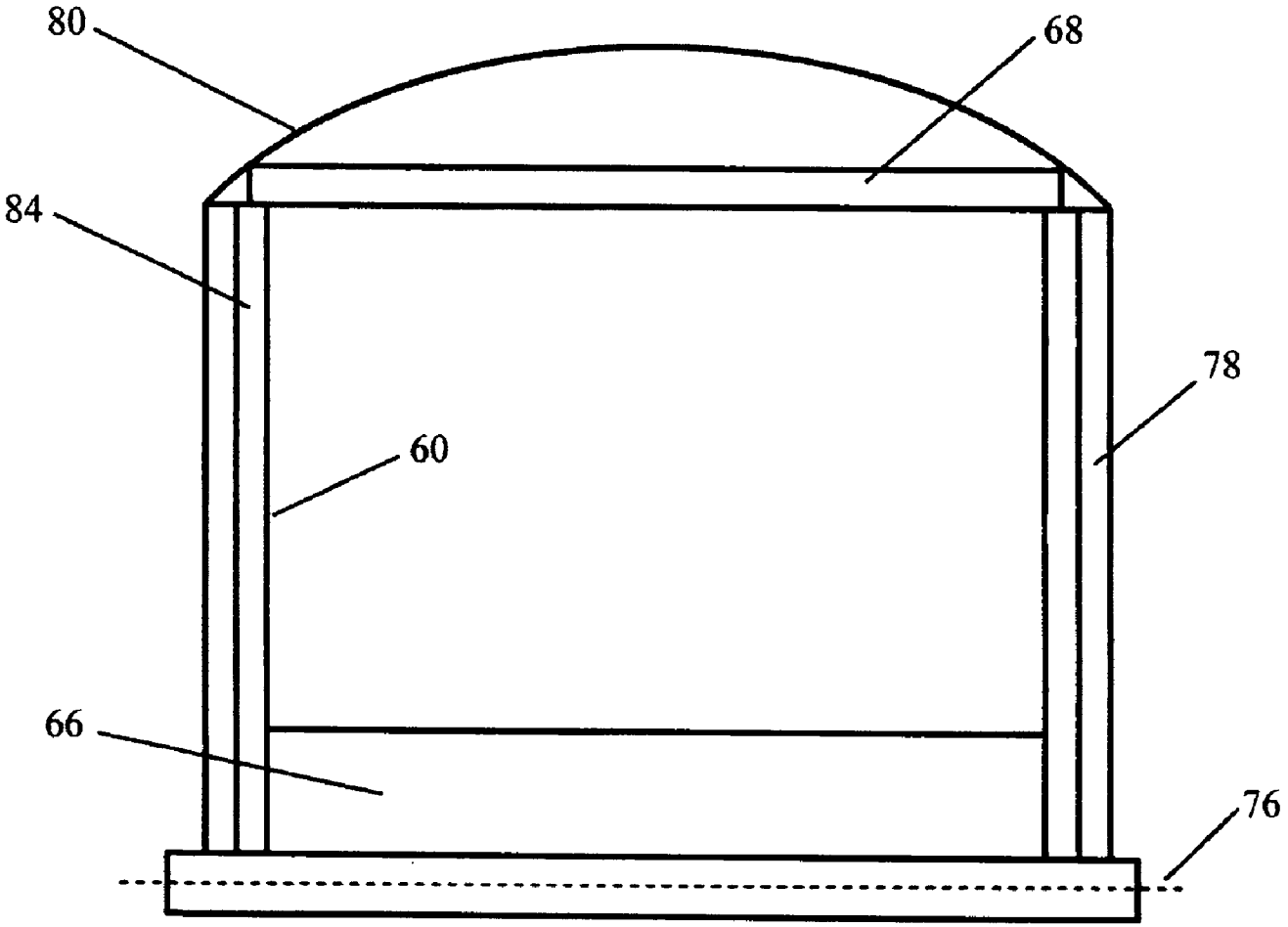
FIG. 13 depicts two illustrated examples of membrane LNG storage tanks.

FIG. 13 depicts two illustrated examples of membrane LNG storage tanks. In FIG. 13, a Membrane system utilizes a membrane material capable of containing the LNG. The membrane type storage tank can be a pre-stressed concrete tank with a layer of internal insulation covered by a membrane, such as a thin stainless steel membrane, that is capable of containing the LNG and serves as the primary container 60. In this case the concrete tank 78 supports the hydrostatic load which is transferred through the membrane 60 and insulation (in other words, the membrane is not self-supporting or load bearing). The membrane can shrink and/or expand with changing temperatures.

Figure 14:
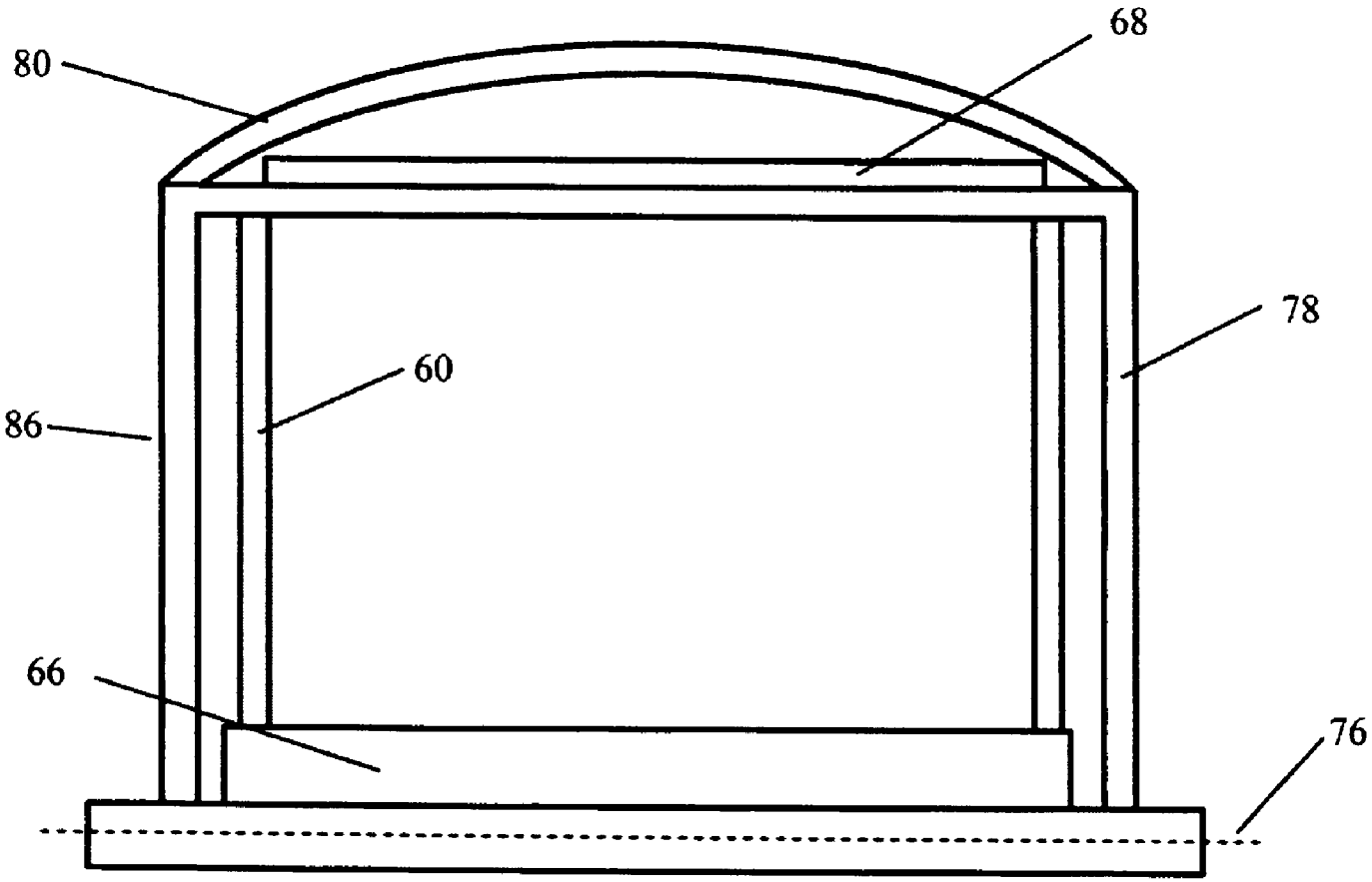
FIG. 14 depicts two illustrated examples of cryogenic concrete LNG storage tanks.

FIG. 14 depicts two illustrated examples of cryogenic concrete LNG storage tanks. The primary container 60 can be constructed of cryogenic concrete that is designed to withstand the cold temperatures of LNG service. The secondary wall 78 can be constructed of pre-stressed concrete and can have a carbon steel liner 86.

Figure 15:
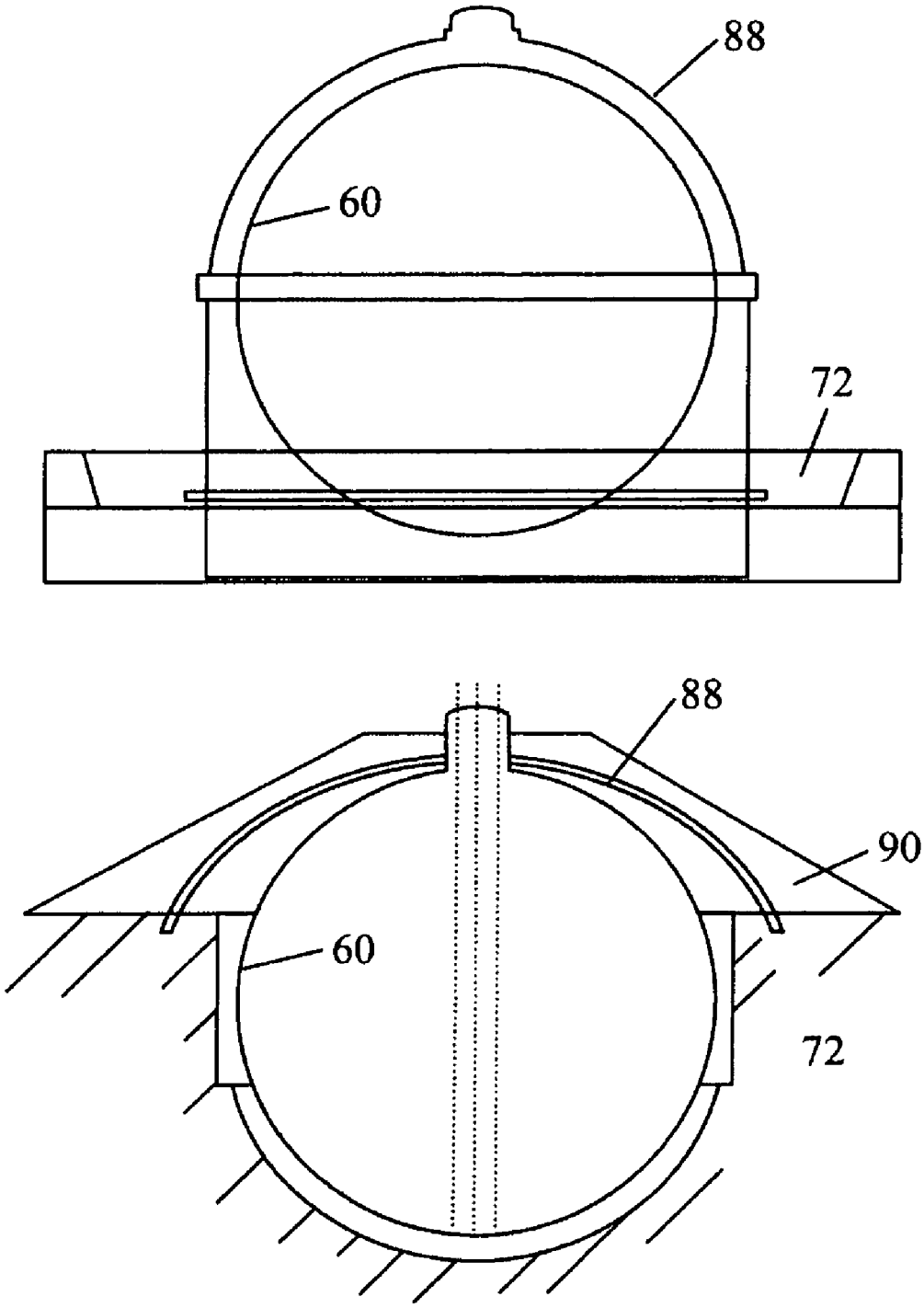
FIG. 15 depicts two illustrated examples of spherical LNG storage tanks.

FIG. 15 depicts two illustrated examples of spherical LNG storage tanks. The primary container 60 can be enclosed within an outer shell 88 that in some embodiments can be partially buried or covered with an earthen berm 90.

The common industry practice is to have all connections to the tank (e.g., filling, emptying, venting, etc.) through the roof so that in the event a failure of a line should occur the failure will not result in emptying the tank. Each tank can have the capability to introduce LNG into the top or the bottom section of the storage tank. This allows mixing LNG of different densities and can reduce rapid vapor generation. Filling into the bottom section can be accomplished using an internal standpipe with slots, and top filling can be carried out using separate piping to a splash plate in the top of the tank.

Seismic Requirements: Seismic design requirements are dependent on the geographic location for the tank. Some locations have good quality data available for specifying the seismic design requirements. Other locations may have a history of seismic activity but the quality of data available may not be comprehensive. This may lead to over or under specification for the earthquake intensities for the operational basis earthquake (OBE) and safe shutdown earthquake (SSE) cases. At a seismically active location a large diameter tank with a low height to diameter ratio may result in a more economical design compared to a design utilizing seismic isolators. Installation of seismic isolators requires two base slabs and may reduce the horizontal and vertical seismic design forces by 50%. For example, the tanks at Marmara Eregisi terminal in Turkey have a large diameter with low height design, whereas those at the Revithoussa terminal in Greece have seismic isolators under the tank base.

Tank Design Pressure: Full Containment tanks have been designed for pressures up to 300 mbarg, whereas Single and Double containment tanks have been traditionally designed for 150 mbarg maximum and usually much less. Higher operating pressures of Full Containment tanks with concrete roofs allows the installation of lower capacity vapor handling equipment for ship unloading, which can result in substantial cost savings. All metal tanks have been built with 250 mbarg design pressure. The additional cost from increasing the pressure from 150 mbarg to 250 mbarg was reported to be approximately 2% of the tank cost. The higher design pressure capability gives a distinct advantage in reducing the cost of vapor handling equipment. However, with Single Containment or other bare steel roof higher pressure designs, the high cost of long pipe runs, deluge water and foam equipment can not be eliminated.

Condensation in the Annulus of a Double-Walled Cryogenic Storage Tank

Inflow of Vapor into Annulus: The absolute pressure in the annulus is essentially the same as in the vapor space of the tank. Therefore, any condensed vapor should be replaced by inflow of vapor into the annulus. If this incoming vapor has the same composition (and hence the same dew point) as the condensing vapor, condensation may continue. But if the incoming vapor has a dew point temperature lower than the inner-tank-wall temperature the vapor will not condense in the annular space. Consider a case where the annulus contains pure methane. If LNG containing nitrogen is then introduced into the tank the methane vapor in the annulus will condense because of the colder LNG temperature. However, the boil-off vapor from the LNG will be a mixture of nitrogen and methane, with a dew point temperature lower than that of methane. This nitrogen-methane mixture will replace the condensed methane vapor in the annulus, and further condensation will stop. For this case the total amount of condensation will be limited to the amount of pure methane in the volume of the annulus. The condensed methane will re-vaporize due to heat leak. Because of buoyancy forces the methane vapor will flow up the face of the outer wall and eventually escape from the annulus. For a period of time a methane-rich zone will exist near the bottom of the annulus and this may create a cycle of vaporization and recondensation.

Warming of The Tank Contents: When condensation occurs in the annulus, there is heat transfer from the annulus to the liquid in the inner tank. A temperature driving force across the inner-tank wall is therefore essential. As the tank contents warm up, the available temperature driving force and the rate of condensation will decrease. To illustrate this case consider an LNG tank filled with pure liquid methane saturated at one atmosphere. The tank boil-off vent is then closed until the tank pressure increases by 50 mbar. When this happens, the methane dew point temperature rises by 0.6° C. If the pressure rise occurs within a short period the temperature driving force of 0.6° C. will be available immediately, and condensation will begin. The condensed methane will be replaced by more methane from the tank vapor space, and condensation will continue so long as there is an adequate temperature driving force across the wall. As the condensation proceeds, the liquid in the tank will gradually warm up because the condensation process will give up heat to the inner tank. In addition there will also be normal heat leak through the tank wall, floor, and roof. For 100,000 $m^3$ of pure liquid methane a sub cooling of 0.6° C. represents enough refrigeration to condense over 165,000 kg (390 m3) of liquid in the annulus. For a 50 m diameter tank with a 1 m wide annulus, this condensed methane would represent a pool of liquid about 2.5 m high. For a 50,000 $m^3$ pure ethane or propane storage tank of 40 m diameter the condensation corresponding to 0.6° C. sub cooling would be 1.2 m and 1.3 m of liquid in the annulus, respectively. These figures, of course, have been derived from an oversimplified model, and it is unlikely that operators would permit such a deep pool of condensate to be formed. For a pure component stored in a double-walled cryogenic tank, an increase in pressure can result in severe condensation in the annulus. When the liquid in the tank is a mixture, the dew point of the vapor in the annulus will depend upon the vapor composition, and the severity of condensation will be less than for pure components.

Decrease in Tank Pressure: A decrease in tank pressure will cause a drop in the dew point temperature of the vapor in the annulus. The net result is a decrease in the temperature difference across the tank wall which in turn causes the condensation to either decrease or to stop. This technique is instantaneously effective for pure components.

Methods to Prevent Annular Condensation: Methods to prevent condensation can be selected by establishing the criteria that are necessary for condensation to occur, and then operating the facility so that condensation is avoided. Condensation in the annulus can be prevented by ensuring that at any given tank pressure the vapor in the annular space has a dew point lower than the temperature of the tank contents. Except in the special case of a stratified tank, the temperature in the tank will nowhere be expected to be colder than the bubble point temperature at the tank operating pressure. The dew point temperature of the annulus vapor can be controlled either by controlling the composition of the vapor or by changing the pressure in the tank (and hence in the annulus), but in practice absolute pressure control may not be a suitable method. Usually there will be other criteria that establish the operating pressure in the tank so that pressure is not normally available as a parameter for dew point control. However, as pointed out later, under some situations pressure reduction may be the only available method for lowering the dew point. Effective control of the dew point temperature is best achieved by composition control in the annulus. The annulus is normally dead-ended and filled with perlite and fiberglass insulation. Hence a small continuous purge of a non-condensable gas (or gas mixture) in the annulus can ensure that a low enough dew point is always maintained.

First Stage LNG Loading Pumps: Low-head pumps can be located in each LNG storage tank. These pumps can operate fully submerged in LNG, and can be located within pump wells or columns for easy installation and removal without taking the tank out of service. The pump wells can also serve as the discharge piping for the pumps and can be connected to the tank top piping. These pumps can deliver the desired LNG send-out flow and can also circulate LNG through the ship loading piping to keep the lines cold between times when ships are being loaded. In an embodiment, a suitable discharge pressure for an in-tank pump can range from about 50 psig to about 200 psig. In an alternate embodiment, a suitable discharge pressure for an in-tank pump can range from about 100 psig to about 150 psig. In an alternate embodiment, a suitable discharge pressure for an in-tank pump can range from about 100 psig to about 125 psig.

Two types of loading pumps are a vertical pump with submerged motors, and vertical-shaft, deep-well pumps with externally mounted motors. Both types can be used and alternatively or additionally multistage horizontal pumps can be used. Vertical pumps with submerged motors are most often chosen.

Vertical Pump: A vertical pump with submerged motor can be constructed in such a manner that the pump with motor drive is hermetically sealed in a vessel and submerged in the liquid being pumped. The major advantage of this design is that the extended shaft with its associated seal is eliminated. Since the problems with most cryogenic pumps lies in the dynamic seals, eliminating them may provide a more reliable design. This type of design has the pump and motor surroundings 100% rich in LNG, and thus would not support combustion. Also any ingress of moisture is stopped and problems due to differential shrinkage of materials is reduced or eliminated. In this design the LNG itself cools the motor windings and lubricates the motor bearings. This type of pump may be used in ship loading and unloading applications and for pumping of LNG out of LNG storage tanks. In some embodiments utilizing a high head submersible pump can eliminate the need for second stage LNG send-out pumps.

Vertical-Shaft Pump: A vertical-shaft pump is configured with an externally mounted motor connected to a pump by a shaft, requiring a seal between the pump and shaft. The seal can be a mechanical seal. A vertical-shaft deep-well pump with an externally mounted motor can be used for LNG service, but can pose safety concerns regarding the possibility of failure of the mechanical seal on the extended shaft and possible exposure to LNG vapors to the externally mounted motor. If the first stage send-out pumps are located inside the tanks, they will likely be of the submersible design. If they are outside the tanks, however, then they will most likely be a considerable distance from the tanks; that is, the unloading pumps will be located out of the confines of the diked area, and the risk of exposure to LNG vapors is reduced, thereby making the use of a vertical-shaft pump feasible.

LNG Storage Pumps: In one embodiment the pumps are inside pump columns located within the storage tank that extend to the storage tank roof The key design feature of this pumping system is that it is possible to pull the pump for maintenance while continuing to operate the storage tank. There can be a foot valve at the bottom of the column that prevents LNG from entering the column when the pump is pulled. The operators purge the column with nitrogen, and then remove the pump from the top of the column. The LNG loading pump capacities are often based on filling a ship in twelve hours. The liquefaction plant typically can have multiple storage tanks and 2 to 4 pumps per tank. It is common to have a total of eight pumps running during loading, each with a capacity in the 1100-2000 cubic meters/hr range and 150-240 meters of head. In many plants there is also a smaller pump in each tank in addition to the loading pumps. The purpose of this smaller pump is to recirculate LNG in the loading lines and stabilize the temperature when no ship is present. The loading lines can be large diameter (for example, 24 inch to 36 inch) and are typically kept cold between ship loadings because cooling them down is a long procedure.

The pumps used for the in-tank application can be similar to the LNG product pumps except they are mounted in a column connected to the top of the tank instead of in a vessel. The pumps can use submerged motors that are cooled by passing the LNG product flow past the windings of the motor. Special care must be taken when the pumps are removed from the tank because the winding insulation can be very hydroscopic and can absorb moisture. Nitrogen purging of the pumps is recommended when they are not in use. The condition of the pumps can be monitored by using accelerometers mounted on the pump housing close to the bearings. The pump bearings are typically a stainless steel material and lubricated by the LNG product. Reliability of the foot valve is as critical as the reliability of the pump. The foot valve is required to seal when the pump is removed to allow the tank to remain in service and is typically supplied by the pump supplier as an integral part of the pump. The weight of the pump sitting on the foot valve causes the foot valve to open and allows LNG to enter the pump and column pipe.

Insulation

Insulation: Some of the basic types of insulation used for LNG plant piping are mechanical types or vacuum jacketing. Within the mechanical types there is also the distinctions of pre-insulated vs. field-insulated; and polyurethane vs. cellular glass such as FOAMGLAS® from Pittsburgh Corning Corporation. Many LNG facilities use polyurethane due to its good thermal conductivity and because polyurethane is relatively economical. However, since polyurethane is less impervious to vapors than FOAMGLAS®, provisions must be made to ensure that a good vapor barrier is provided to protect the insulation from deterioration due to water ingress. It is also important to design the insulation system such that combustible gas does not leak from the piping into the insulation because this may present a hazard. FOAMGLAS® is advantageous in that FOAMGLAS® is impervious to water vapor; thus it is easier to protect against insulation deterioration due to water ingress. FOAMGLAS® also has a higher compressive strength than polyurethane, which can result in a more durable application.

Preinsulated piping offers advantages because it minimizes field labor and because production-line manufacturing can in some instances increase quality control. The major disadvantage of preinsulated pipe, aside from cost, is the possibility of shipping and schedule delays. Preinsulated pipe is usually shipped to the facility site with the ends left bare. The pipe can then be welded and the ends are then field insulated via preformed rigid insulation or the insulation can be field applied in the manner referred to as poured-in-place. In general it is preferred to use preformed rigid insulation for larger piping because there can be problems associated with large pours.

Vacuum-jacket piping may also be considered for LNG facilities. This type is constructed such that there are two piping walls; the inner wall that is constructed of a material to contain the LNG and an outer wall that may be constructed of carbon steel or other material. The annulus between the two piping walls can be filled with insulation, evacuated to form a vacuum or near vacuum conditions, and then sealed. The heat leakage from this system can be substantially less that of the typical mechanical types of insulation. Under special circumstances it may be worthwhile to design a piping system that has two structural barriers capable of containing the LNG. This may be accomplished in several ways, such as for example, the vacuum-jacket piping may be designed such that the outer pipe is also suitable for cryogenic temperatures. Alternatively, the piping may be installed within a cold box that is constructed to withstand the internal and external forces. For example, a concrete cold box could be installed; the cold box could be filled with bulk insulation, sealed and pressurized.

Safety

A real-time plant management system known as the LNG Plant Advisory System (LNGPAS™) has been developed at KBR to guide and assist the LNG Plant Operators in the safe control and operation of the LNG storage facility. LNGPAS is an advanced process control system which combines conventional programming techniques with knowledge based system technology to reduce the complexity of monitoring and controlling the operation of an LNG storage facility. The system receives on-line process data from existing sensors, analyzes them, detects abnormalities, and advises LNG plant operators on any corrective actions. For example, the events which may lead to a potential tank content "rollover" situation or the effects of any corrective actions recommended to prevent a "rollover" situation can be predicted and analyzed using the built-in process simulator.

Some type of alarm prioritization system or other operator advisory system has become a necessity for safe plant operation. The lack of such a system may result in an operator's alarm saturation syndrome which could develop into a potentially hazardous situation owing to lack of operational response to incubation of rollover leading to dangerous events. This is particularly true in LNG terminals where operators are continuously involved in the movement of large stocks of product and concurrently handling the vapors generated by those transfer operations. In these LNG terminals, a safe design demands a large number of alarms that require the operator's attention; some immediately and others in the shorter or longer term. With time and the operator's increased familiarity with the plant, however, many of these alarms tend to lose their sense of urgency, especially those which are not very frequent or do not require immediate attention. Under these conditions, potentially dangerous situations may arise, which could be avoided if timely preventive measures were implemented. One typical example of such a situation is when gas of a given composition and light density is added to a storage tank partially filled with gas of a different composition and heavier density. The formation of two layers of LNG product inside the tank may result owing to inadequate mixing. The mixing of the stratified layers is accomplished by a massive/rapid increase in vaporization rate that could develop into a hazardous situation. This hazard can be minimized by adopting safe operating procedures for loading LNG into storage tanks, as well as by taking the necessary corrective actions to assess the case of a potential rollover in an incubating tank. Real-time knowledge based systems are ideally suited for these kinds of problems. The process knowledge entered into the system as rules can validate and analyze sensors/alarms, identify trends, diagnose abnormalities, recommend or take corrective actions, and so on.

Rollover: Filling a cryogenic LNG storage tank with production or shipments of different densities may result in the formation of stratified liquid layers (fill-induced stratification). Once stratified liquid layers are formed, the heat-leak into the tank from the surroundings into the bottom layers is not released and is stored as superheat. This is owing to the inability of the natural convection currents in the bottom layer to penetrate entirely through the top layer and come to the free surface to release heat as vapor. As a result, the density of the bottom layer decreases with time owing to its increasing temperature. At the same time, the top layer is continuously able to release its heat in-leak by vaporization of lighter components, which results in a continuous increase of its density owing to concentration of heavy components. A rollover can occur when the density difference between the two layers becomes sufficiently small that the natural convection currents from the bottom layer come to the free surface. The subsequent mixing of these layers is accompanied by a large increase in the normal vaporization rate, which will be proportional to the amount of superheat accumulated in the bottom layer. This physical phenomenon associated with the mixing of stratified layers of LNG is commonly and descriptively referred to as "rollover". If several layers of stratification develop at a given time, the same phenomena may occur among the different layers. In that case, roll over of bottom layers may develop without heat release and may continue until only two layers remain. Similarly, the top two layers may rollover with the corresponding vapor release, subsequent to which the tank remains stratified with the new top layer and the remaining existing bottom layers.

Stratification and subsequent rollover are not always undesirable. Generally, the contents of a well-mixed tank roll over continuously with low vapor release. A rollover of high intensity can result, however, in vapor release in excess of the designed vapor handling capabilities of the tank and can thus overpressure and possibly rupture the tank. The resulting hazardous scenario must be avoided and all precautionary steps should be taken to prevent stratification as well as to defuse the stratification once stratification occurs. This rollover phenomenon is not exclusive to LNG; rollover can also occur in liquefied petroleum gas (LPG) stored at atmospheric pressure, and even in pure materials such as ammonia, ethylene, or ethane, usually with very minor release of vapors if initial temperature stratification develops as a result of, for instance, addition of a warmer product on top of a colder one. The phenomenon of self-stratification is also possibly a result of the weathering process of an initially homogeneous tank. For instance, high concentration of nitrogen in the LNG (about 4% or higher) can result in self-stratification and moderate rollover, because the boil-off from the free surface decreases the nitrogen concentration in the upper layer of the stored liquid, which makes the upper layer lighter than the bottom liquid. Rollover can generally be prevented by following good operating procedures. It is possible that, owing to a number of causes (operator error, lack of available storage or proper top and bottom filling devices, etc.), stratification may still develop in a given tank. When stratification is detected, corrective action can be taken, such as recirculation from bottom to top or bottom to bottom of the tank—after releasing its superheat by flashing vapors or accelerated sendout—to avoid the hazardous consequences of a serious rollover.

Rollover risk can be minimized by using the following sub-systems: Stratification Detection System; Filling/Sendout System; Process Simulation System; Alarm Management System; Maintenance and Diagnostics System, The stratification detection system monitors the density and temperature profiles along the liquid height of each storage tank. The stratification detection system compares these measurements and notifies the operator when stratification is detected and advises on any corrective action. The filling/sendout system monitors the filling and sendout operations of all storage tanks. Operator decides on whether to use top or bottom filling procedures when filling a tank and which tank to use for filling, sendout or any other transfer operation based on density, composition, and temperature data. A process simulation system can be used to simulate dynamically the events leading to potential rollover or to analyze the effects of any corrective actions recommended to prevent rollover. The process simulation system predicts incubation time and performs overall heat and material balances on each tank and the whole storage area. The alarm management system monitors alarms and trips in the storage area. The alarm management system determines the events which may lead to an alarm or trip activation, established their urgency level, and recommends type of operator intervention. The maintenance and diagnostics system monitors key operating and mechanical parameters for machine performance, analyzes them and correlates data to provide preventive maintenance.

Stratification detection: Several methods are available to detect stratification in LNG storage tanks, such as density measurement along the height of the tank; temperature profile along the height of the tank; measurement of changes in the vaporization or boil-off rates; and/or measurement of changes in the boil-off composition.

Typically, the most reliable measurement is the density along the height of the liquid in the tank. This is normally provided by a probe that can travel the full height of the tank and routinely measures the density at different levels. The number and frequency of these measurements can be changed as desired in order to determine as closely as possible the existence of stratification and the thickness of the stratified layers. These measurements are recorded routinely at the shortest practical time intervals. If stratification is detected, the reading/measurement intervals can be repeated as frequently as necessary, at the same time, temperatures along the height of the tank can also be measured and monitored regularly to detect sudden changes in temperature profile which may indicate stratification. Temperature profiles are not as reliable as density profiles in detection of stratification but are helpful when combined with density profiles. The real-time knowledge-based system primarily monitors the density and temperature profiles of the tank to detect stratification. The system also calculates the heat and material balance of the storage/loading area and predicts the normal boil-off rate which is then compared with the actual boil-off as a further check in case of large deviations for the detection of stratification.

Stratification Detection System: This system monitors the density and temperature profiles along the height of the storage tank. The system compares the density and temperature measurements at a given height with the density and temperature measurements at the adjacent level immediately below and makes a determination whether the tank is stratified at that level or not. These comparisons are performed at every level for which the density and temperature measurements are available, starting from the bottom of the storage tank and continuing until the maximum liquid level is reached. The system performs these comparisons at fixed time intervals, when new sets of density and temperature profiles are made available. The system also maintains historical trends of these profiles for future reference and the system notifies the plant operator whether or not stratification was detected at every level for which the density and temperature comparisons are made. If stratification is detected, the system can estimate the thickness of stratified layers and calculate their average density and temperature. These values are then used to estimate the rollover incubation time and intensity, using appropriate parametric equations, and/or by performing a series of process flash calculations. At this point, the system advises the plant operator on any corrective actions and recommends the start-up of one or more re-circulation pumps to minimize the rollover intensity and extend the incubation time. The system also recommends a recirculation mode (bottom to top or bottom to bottom) based on the expected intensity of rollover.

LNG Storage Tank Filling/Unloading System: This system monitors the filling, unloading or standby operation of a storage tank to minimize or prevent stratification. The system advises the plant operator on whether to use top or bottom fill procedures when filling a storage tank. This determination is made based on the density difference between the LNG in the storage tank and that of the incoming LNG to ensure adequate mixing. The system estimates the tank boil-off or vapor intake rate, by taking into account filling or unloading flow rates, boil-off owing to heat leak from the surroundings, pumping energy, vapor generated due to liquid flash, etc. The system also provides a variety of other useful information, such as total volume filled or unloaded, time required to fill or unload a tank and so on.

Process Simulation System: This system consists of a built-in process simulator and database with the ability to perform different types of flash and heat boundary layer penetration calculations. The system can be used to simulate the events that may lead to potential rollover situations and to determine how the density and temperature of the stratified layers may change with respect to time based on the composition of various layers, recirculation rates, and heat leak from the surroundings. The system can also be used to see how the rollover incubation time and intensity may be affected based on operator corrective actions. The simulation results can be presented in graphical or tabular format. LNGPAS was developed using the Realtime Advisory Control (RTAC) System environment by Mitech Corporation. The system also uses KBR's specialized process simulator to perform heat and material balance calculations. The current system can be adapted to various equipment configurations and enhanced to handle multiple tanks or provide full heat and material balance calculation capability. The system can be used as an operator training tool and also as an alarm prioritization system capable of determining the event(s) leading to alarms, establishing their urgency level and recommending timely operator intervention. The LNGPAS is a user-friendly menu-driven system that allows the operator to switch from one system to another and access sensor data or other pertinent information.

Depressuring System: In addition to the conventional pressure relief system, a depressuring system is generally provided to reduce the internal pressure of equipment either involved in or adjacent to a fire. An overall depressuring system can be segregated into many independent circuits that can be discharged into the flare system on a controlled basis. Thermal effects and flare sizing are important design considerations.

Thermal Effects: Remotely operated vapor depressuring valves are provided as per API RP521 for equipment/piping systems containing more than two tons of liquid hydrocarbons (butane or lighter). The depressuring of hydrocarbons, however, results in significant temperature reductions that must be carefully analyzed. For example, the lower temperature may determine the materials of construction; the formation of liquid from isentropic vapor depressuring and the continued depressuring of the liquid may result in significant temperature reduction in the equipment; the gas entering or leaving a vessel during depressuring may significantly lower the nozzle design temperature, relative to the shell, due to the high gas velocity and resultant high heat transfer rate at the nozzle; and/or depressuring a distillation column with light liquid hydrocarbons present may result in freezing the reboiling media (condensate, hot water, etc.). In this case, proper feed forward instrumentation for quick draining of the heating media or a method to maintain continuous flow of the media may be necessary.

Flare Sizing: Since the depressuring system is a significant load on the flare system, the interaction of the two systems is important in the overall integrated design. Flare sizing should consider the impact of the depressuring system upon the dynamics and thermal shock of the flare system and should avoid simultaneous release of depressuring circuits under operator control. Flare sizing should optimize the size of the depressuring circuits and their resulting load on the flare system; for example, the multi-staged propane refrigeration system may be divided into separate circuits via solenoids and trip valves to ensure the depressuring of two individual circuits on a staggered basis. Flare sizing should ensure that the depressuring circuit does not relieve faster than design (usually fifteen minutes). This may require the use of travel stops on depressuring valves.

Emergency Shutdown (ESD) and Emergency Depressurization Systems (EDS):

The safety of personnel, plant equipment and environment is achieved in part by the implementation of an emergency isolation system and an emergency depressurization system which is activated in case of fire, potentially dangerous process upsets, or hydrocarbon leakages. The process plant area can be divided into possible fire zones with sectional plot areas containing equipment with a given maximum hydrocarbon inventory. Proper arrangement of the process equipment should be considered during the plot plan design that could result in comparable volumes of hydrocarbon $C_4$ or lighter liquids per each fire zone. Each zone can be isolated at its boundaries by the emergency shutdown valves before proceeding to depressurization of equipment. Depressurization is the rapid reduction of process equipment pressure by relieving its inventory to flare or vent. This is particularly important for a vessel exposed to fire. Relief valves are designed to keep vessels below their design pressure, but not to reduce the pressure. As fire increases the metal temperature thus reducing the material strength, lowering the vessel pressure reduces the stress on the metal, which reduces the risk of the vessel bursting, therefore reducing or preventing further damage to the plant. Depressuring rates are proposed in API-521.

There are other potentially dangerous situations where it is desirable to remove the process fluid inventory from the process equipment to a save destination, for instance, equipment close to an area on fire. In such cases the plant may be depressured through either vapor or liquid depressuring valves to suitable flare or vent facilities. The depressuring process results in a rapid isentropic expansion of the vessel content as the depressuring performs work on the relieved fluid. This will cause drastic reduction on the temperature of the fluid in the vessel particularly when depressuring mixtures of low boiling point hydrocarbons. Since heat transfer between the vessel and its contents can reduce the vessel metal temperature to below the ductile/brittle transition temperature, depressuring can severely reduce the stress on the equipment. Therefore, the depressuring scenario often determines the minimum design temperature of the process equipment.

The depressurization philosophy adopted in the design is a critical factor in pertaining to metallurgy selection in an LNG liquefaction plant. The main criteria are whether the repressurization is allowed while cold or not. If an immediate repressurization is possible, impact test qualified low temperature and cryogenic grade materials will be required in most portions of the liquefaction and fractionation trains. If controlled repressurization is adopted, not allowing repressurization while the equipment or piping is at cold liquid temperature, the use of fine carbon or low alloy steels will predominate in the plant design. In the former case the cost of the plant increases significantly but impact test qualified low temperature and cryogenic grade materials provide additional safety in case an operator does, in fact, repressure the plant after a plant upset that resulted in depressurization. In the latter case the cost of the plant is reduced, but the operator is not allowed to restart for an immediate repressurization while the plant equipment or piping is at cold liquid temperature, thus reducing plant availability. It is important, however, to have adequate temperature measurements to ensure safe repressurization.

Liquefaction Plant Layout

Overall layout of the plant, i.e. location of the storage area, the process area, utility area, loading area, flares, control room, etc. have to take into consideration not only the operating units inside the battery limits but also the communities outside the plant boundaries. Separations between above areas should allow for effective fire fighting and to avoid fire from one area to propagate to others. Each area should have access from at least two different ways. Equipment with a high inventory of flammable material which could develop large vapor clouds in case of leakage should be located downwind of the prevalent wind direction away from community areas, control rooms, warehouses, etc. Electric power to the plant should be provided through at least two separate feeder circuits and the fire water system should be looped around the entire plant such that any fire water unit can be supplied from either direction.

In developing an overall layout, calculations of the thermal radiant profile and vapor dispersion contours produced by code specified spill rates have to be checked to ensure compliance with the applicable codes. As an example, NFPA 59A code specifies that provisions shall be made to minimize the possibility of the damaging effects of fire or a flammable cloud of vapors from such a design spill to reach beyond a property line that can be built upon and that would result in a distinct hazard. Therefore, the battery limits of the LNG facility may be set by the above calculated vapor and thermal radiant contours. Today, the possibility of a hostile attack on an LNG facility is of concern and a generic assessment of the worse case consequences resulting from a deliberate action against the facilities should be considered. Of course, the risk of such an event must be weighed in terms of the severity of the consequences as well as the probability of occurrence. The assessments of the consequences have to be backed by an evaluation of historical, experimental and theoretical evidence. The results of the analysis can then be included in the hazard footprint to identify those areas at risk from gas cloud dispersion or radiated heat from fire. Similarly, ground level concentration of gases released from vent and/or flare have to be calculated in order to ensure proper concentration levels beyond the plant boundary limits.

At the same time, process area layout of equipment should be arranged to minimize piping between equipment, to provide area for the cleaning and maintenance of equipment, and to provide depressurization in case of fire or to protect nearby equipment from an existing fire. Different areas within a unit should be properly curbed and drained to avoid the possibility of pooling of flammable material under equipment and to direct spills to designated impounding areas. Numerous factors such as personnel safety, process safety, accessibility, operability and maintainability have to be considered carefully in a facility layout as these issues are typically interrelated. Often the final facility layout is a compromise among these various but inter-related factors.

One way to achieve a safe and economic layout is by studying different layouts using three-dimensional software and estimating the thermal and vapor dispersion profile on each one of the different layouts. This procedure can be done quite fast if variations of the layout are carried out by simple re-plotting of the main equipment which is then followed by computer re-running of the pipe-racks and production of the cost estimate for the new piping arrangement.

Instrumentation

The measurement of operating conditions, such as for example, pressure, temperature, flowrate and liquid level are important in LNG plants. For cryogenic applications, however, special instrument design details may be necessary to ensure that the measurements are accurate and reliable. The accurate measurement of liquid level in a vessel via a differential pressure (D.P.) cell can be critical in an LNG liquefaction plant.

Figure 17:
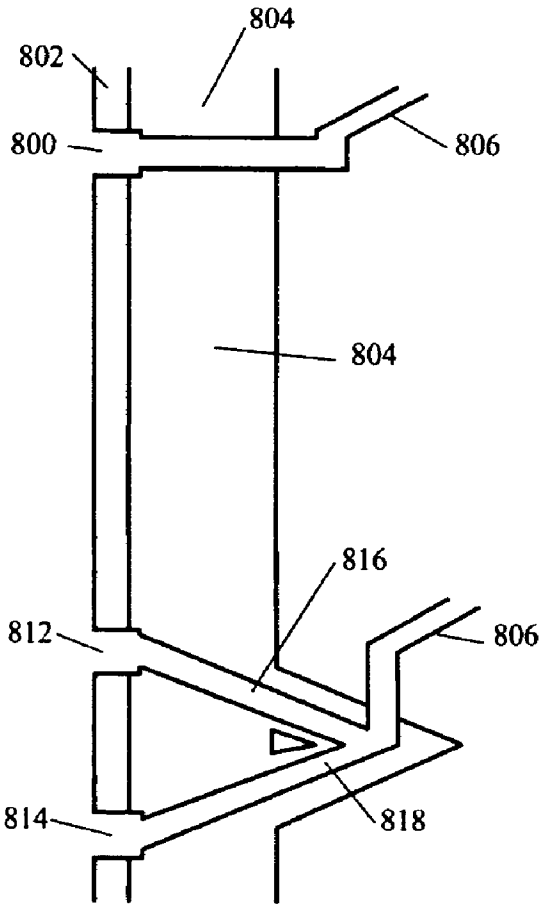
FIG. 17 depicts a schematic illustration of an alternate thermosyphon tap arrangement.
Figure 16:
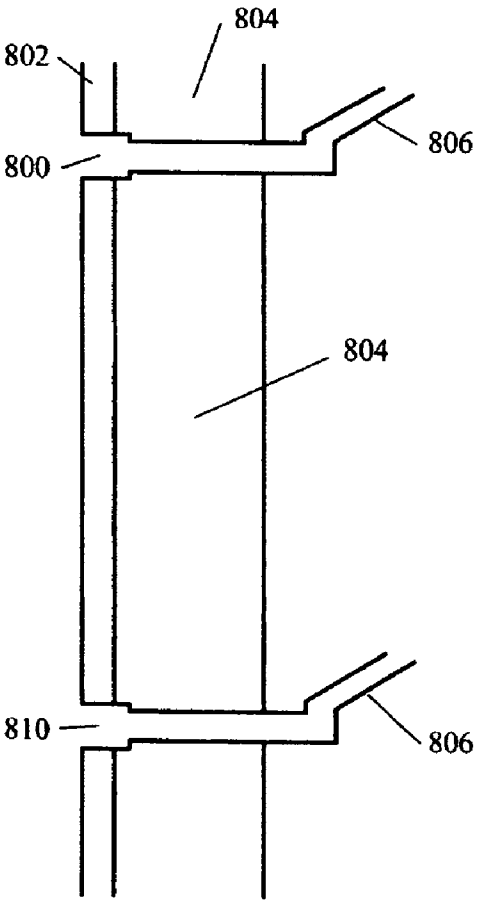
FIG. 16 depicts a schematic illustration of a conventional tap into a vessel.

Level Measurement via Differential Pressure (D.P.) Cell: FIG. 16 depicts a schematic illustration of a conventional tap into a vessel. An upper tap 800 penetrates the vessel wall 802 and vessel insulation 804, the upper tap outside of the insulation 804 can have an upward slope 806 and proceed to a differential pressure transmitter. A lower tap 810 penetrates the vessel wall 802 and vessel insulation 804, the lower tap outside of the insulation 804 can have an upward slope 806 and proceed to a differential pressure transmitter. The differential pressure transmitter can measure the difference in pressure between the upper 800 and lower 810 taps. FIG. 17 depicts a schematic illustration of an alternate thermosyphon tap arrangement. FIG. 17 demonstrates an arrangement that is more suitable for measuring the level of LNG. A thermosyphon arrangement on the liquid level taps can be used to ensure constant vapor formation at point A. Instead of a single lower tap there are two, a first lower tap 812 and a second lower tap 814. The first lower tap 812 can have a downward slope 816 to junction point A, whereas the second lower tap 814 can have an upward slope 818 to junction point A, where the first lower tap 812 and the second lower tap 814 connect. After connecting at point A the lower tap can have an upward slope 806 and proceed to a differential pressure transmitter as in the conventional system. The connection and slopes of the first lower tap 812 and the second lower tap 814 create a thermosyphon arrangement on the lower taps to ensure constant vapor formation at point A. The circulation through the thermosyphon is facilitated by the ambient heat leak that is controlled by the proper combination of insulation thickness, tube diameter and slope. This technique may solve the two main problems that exist with the conventional approach: a stagnant tube encourages the plating out of solids (such as carbon dioxide, benzene, etc.) present in the LNG that can result in tube plugging; and a rising level in the tube creates vapor and a resultant higher pressure that provides a false pressure signal from the bottom level tap.

These problems may be solved by the constant circulation and continuous vapor generation that is achieved in the system shown in FIG. 17. There are other techniques such as the use of a bubbler (introduction of an external bubbling gas) that may also resolve the above-mentioned problems but may not be as reliable or as simple as the design provided above.

Shell and Tube Exchangers

Materials of Construction: Normally the selection of materials is straightforward. The major area of concern for exchange services near −46 degrees Celsius is the selection of the proper minimum design temperature. Since the design break point between impact tested carbon steel and stainless steel is −46 degrees Celsius, the impact of depressurization (including tube rupture) and the resultant temperature drop must be carefully analyzed to make the correct materials choice.

Thermal Stresses: As a rule, to minimize thermal stresses on a fixed tubesheet exchanger, limit the temperature difference between the shell and tube to about 20-40 degrees Celsius. The actual allowable stress on the exchanger is evaluated for each exchanger. Just as for the materials of construction selection, a design temperature analysis is necessary to determine temperature variations during normal operation as well as during start-up, shutdown, depressurization, etc. For example, in normal operation, the propane level on the shell side of a feed/propane kettle exchanger must always be above the tubes. If not, the tubes above the propane level are warmed to the feed temperature which results in tube expansion and possible excess stress at the tubesheet and the shell/tubesheet interface.

Leaks: A leak analysis is recommended before the exchanger design is finalized to assure that the exchanger type and details are suitable for the service intended. A leak analysis should include examination of the potential cause of leak, the probable direction of leak, the effect of leak on process operating conditions, the method of detection in operation, and the recommendations on leak prevention, repair, exchanger type, and necessary design details.

Orientation/Configuration: With a few exceptions, conventional orientation and configurations are employed, but in some cases modular engineering techniques are applied to save on heat exchanger and piping costs. An example can be a modular exchanger design for feed and mixed refrigerant cooling via propane refrigeration. The process fluid can flow without interruption from one exchanger to the next, thereby the normal exchanger heads and connecting piping can be eliminated on several of the exchangers.

Two-Phase Flow Distribution: The primary area where two-phase flow distribution is important for shell and tube exchangers is in the feed and mixed refrigerant cooling via propane forecooling. With the conventional arrangement, there is separation of the tubeside liquid and vapor between exchangers with the liquid flowing preferentially through the lower bank of tubes. The net result of this separation is to increase both the overall heat transfer surface and the refrigeration power. The modular butted tubesheet arrangement discussed above overcomes both these drawbacks.

Plate Fin Exchangers

Materials of Construction: These exchangers are made of aluminum, which is subject to corrosion attack by mercury. If the mercury in the feed gas can not be eliminated, then the use of plate fin exchanger systems will provide questionable reliability.

Thermal Stresses: The problems are very similar to shell and tube exchangers; however, the transient temperature analysis is more complicated since the exchanger usually transfers heat between two or more process streams. Generally, it is advisable to limit necessary temperature variations in operation as much as possible. Normally, thermal shock is more important in stress evaluation than the normal steady state temperature difference.

Leaks: The same considerations as for shell and tube exchangers apply; however, in a plate fin exchanger, leaks caused by pressure from freezing components such as water, oil, etc. are more likely. Thus, keeping the system clean is essential, filters are recommended on the inlet stream to keep out dirt, scale, etc. that may clog up the relatively small passages within a plate fin exchanger.

Orientation/Configuration: Due to the exchanger size limitation, parallel units are typically required; thus, flow balancing between units is important. Proper distribution of a two-phase stream into a plate fin exchanger is essential. Generally, a horizontal configuration is not recommended because of the potential separation of vapor and liquid within the exchanger due to the effects of gravity; thus, a vertical configuration is preferred. The "cold end up" vertical configuration is possible and generally results in reduced pressure drop (power savings) due to taking advantage of the liquid hydrostatic head in downflow. During shutdown, however, an undesirable temperature inversion occurs in the exchanger due to the cold liquid at the top of the exchanger settling to the bottoms. For this reason, this operation is not recommended for plate fin exchangers. Generally, the "cold end down" vertical configuration is preferred. When the cold liquid settles to the exchanger bottoms on shutdown, there are no severe temperature inversions that cause excess thermal stress. Also, the exchanger can be restarted quickly due to the stable temperature profile.

Two-Phase Flow Distribution: If the inlet vapor volume percentage is less than 10% or more than 90% then special inlet distribution is not needed. Between 10% and 90% vapor volume, external separation of vapor and liquid and the forced distribution of each phase into the exchanger via special internals is recommended.

Innovative Heat Exchanger Designs: Enhancements of the conventional shell and tube heat exchanger such as the butted tube sheet design have been effectively used in existing LNG plants, and, along with other modifications such as enhanced surfaces and better materials of construction, will find expanded use in the future. In addition, several new heat exchanger designs have been developed to address the limitations in commonly used heat exchangers. Examples of these new exchanger designs include, but are not restricted to: Heatric (an exchanger made from etched plates fused together to maintain full metal strength throughout the exchanger, available from Heatric, a Meggitt group company of Dorset, UK with a sales office in Houston, Tex.); Packinox (an exchanger made by welding sheets that have been formed by an explosion technique, wherein the plate forming technique reduces residual stress in the material making the material less prone to corrosion attack, available from Packinox S.A. in France, an Alfa Laval company); and High-Flux and Fine Fin (can provide enhanced surfaces to promote high performance via higher heat transfer rates).

Suitable experience at cryogenic temperatures will be needed before these new exchanger designs will be considered proven and replace the more common shell and tube design. Demonstrated experience with multiple streams at cryogenic temperatures will be necessary before the new designs will significantly displace the aluminum plate-fin exchanger.

Piping Systems in the Liquefaction Train

Materials of Construction: In general, natural gas liquefaction can be considered corrosion free since essentially all the acid gases are removed in the feed pretreatment area. Thus the major concern is the correct use of cryogenic materials. In this regard, alloy verification is recommended to ensure that what is installed is what was specified. Also precautions should be taken to ensure that stress corrosion cracking from chlorides contact (contact with salt air during construction, glues on insulation, etc.) does not occur in stainless steel.

Flexibility: Due to large temperature variations and resultant pipe movement, piping support and flexibility analysis is paramount. Also, since different materials have different coefficients of expansion/contraction, transition joint analysis is important when aluminum equipment such as the main exchanger or a plate fin exchanger is connected to stainless steel piping. In the case of long piping runs, an economic evaluation of pipe loops versus expansion joints should be performed.

Valve Location: Pneumatic pressure testing of cryogenic systems is preferred so as to avoid water hydrotesting, as residual water can be difficult to remove from valve packings, bellows, etc. Pneumatic testing has the disadvantage that a large amount of energy is stored in the piping during testing. Thus the proper placement of isolation valves reduces this stored energy to a manageable level. Additionally, shop hydrotesting of the piping and a full or near-full non-destructive testing and inspection of field welds further reduces the potential risk.

Welds: In an LNG plant, an additional consideration regarding welding is the presence of mercury. Aluminum welds (in plate fin exchanger headers for example) are subject to mercury attack. The obvious solution is to eliminate mercury by pretreatment. If mercury is present, however, the following steps help reduce potential damage: set the maximum operating temperature at −40 degrees Celsius; avoid severe stress transients on the welds such as during rapid cooldown; avoid mercury accumulation points such as backup strips or rings on welds; and ensure that the aluminum system is self draining during a shutdown.

Piping Systems in the Storage and Ship Loading Area

Transient Analysis: In the storage and ship loading area the piping runs are typically much longer than in the liquefaction train. A transient analysis should be conducted to avoid excessive pressure in the long piping system due to the effects of water hammer produced by emergency shutdown systems, pumps tripping, etc. After a transient analysis and the optimum selection of valve type and valve closure time, the system design pressure can be established, which is typically significantly above the normal operating pressure.

Bowing Avoidance: If a large cryogenic line is partially filled with liquid, a significant temperature differential is easily established between the top and bottom of the line resulting in pipe bowing due to greater contraction of the pipe bottom compared to the top. This behavior causes excessive thermal stresses on the pipe support system and should be avoided. Thus the cool down method must be designed to eliminate uneven top/bottom cooling of the line via the maximum initial use of vapor cool down from the liquefaction train.

LNG Loading

The liquefaction facility can also include a ship loading terminal. The LNG can be pumped from a storage tank to an LNG ship via a loading jetty. At some locations the jetty may need to be extended several kilometers to reach the proper water depth needed, contributing significantly to the plant cost. The loading lines can be looped for thermal expansion or with expandable bellows. The looped line can have a lower specific cost, but requires more piping material and jetty space. The bellowed line can be straight thus requiring less piping material and jetty space but can also be more expensive due to the cost of the bellows. The loading rate is generally driven by keeping the ship loading time as short as possible and by the cool down time of the ship tank material. The LNG can be transferred onto the ship through loading arms that have swivel joints, which can allow limited ship movement during LNG transfer before automatically disconnecting. The height and weight balancing required for easy movement of the loading arms can result in very heavy equipment. Two or three liquid loading arms are often required depending on hydraulics. An additional arm can be used for vapor that is displaced and generated in the ship that can be returned back to the storage tanks to fill the vapor space. The loading lines can be kept cold during the time then no ship is being loaded by circulating a fraction of the plant rundown to the jetty head and back to the tank. Two designs that are commonly used are two pipelines in the low 20 inch diameter range or one line about 30 inches in diameter.

LNG Tanker Ships (transportation): LNG projects typically require dedicated LNG ships. The number of ships required for an LNG project depends on the distance between the liquefaction plant and the receiving terminal. LNG transportation cost increases linearly with distance. The LNG carriers are typically designed for speeds of 17 to 20 knots. The fleet of tankers for an LNG project is a noteworthy portion of the total cost of the LNG chain. In the LNG ship, the LNG can be stored in a refrigerated liquid state while the LNG is transported. The LNG can be kept cool by evaporating a fraction of the LNG, which is referred to as boil-off. The ship can use the boil-off as fuel for its own engines or can reliquefy the gas. When the ship reaches its destination, the LNG can be offloaded to a receiving/unloading terminal. The facilities near the receiving/unloading terminal can include storage, regasification, and transportation to consumers of natural gas.

Shipping Simulation as Related to the LNG Chain: The most widely used method to date for optimizing the shipping system has been an event oriented simulation of the system. The simulation models the liquefaction plant with appropriate seasonal deviations and maintenance and production constraints. LNG produced in the baseload liquefaction facility is stored in LNG tanks and appropriate losses for heat leaks are deducted. LNG is loaded from the tanks into the ships, which leave the production facility's harbor, travel to the receiving terminal, berth, and prepare to unload. Delays, deviations, and boiloff losses for each event along the route are applied. After unloading the LNG into the receiving terminal's storage tanks, the ship, with any residual LNG, sometimes referred to as its LNG heel, returns to the liquefaction facility. The terminal vaporizes the stored LNG and exports the vapor to its consumers based on their demand. Since the Monte Carlo shipping simulation has many random variables, a long time period is simulated to obtain reasonable and reproducible results. For example, the KBR simulation program typically uses run lengths of from 5,000 to 10,000 simulated days. In addition, the simulation is usually reinitialized and run several times to smooth the statistical results. Five to ten of these "replicates" are typically run. The usefulness of a simulation program as an optimization tool depends on the extent in which the program meets several general criteria. For simulations, the events that make up a model should closely parallel the real system; simplifying assumptions should not adversely influence the simulation results; models should incorporate realistic data and parameters to describe the system; numerical results should be accurate, easily quantifiable and verifiable; and output should be easy to manipulate and analyze.

Results from Simulations: Some of the major variables that are typically examined by shipping studies include the number, size, and speed of ships, the amount of LNG storage and both production and receiving facilities, and the number of loading berths. The relationship between these variables and the total delivered LNG and the cost of shipping can be determined and used as an input into an overall economic analysis.

Additional Requirements for Shipping Simulations: A trend of increasingly detailed analysis of shipping systems is developing for many projects, which requires more detailed input into the simulations. Specific projects require some or all of the following criteria to be included in their simulations. Other projects find they do not have data available to allow creation of an accurate model or that these details have data available to allow creation of an accurate model or that these details have little effect on the simulation results.

In shipping simulations, weather effects in the LNG transportation system, especially for potential bad-weather sites and shipping routes. Seasonal variations, latitude and specific geographical area weather variations, and effect on overall traveling speed and harbor availability also need consideration.

In detailed harbor simulations, harbor geometry and operations may have an influence on ship operation. Interest is increasing in more detailed models of harbors. Criteria include specific daylight and tide restrictions, restrictions on multiple ship movements, berth and jetty geometry, and loading rates as a function of number of berthed ships.

In berthing criteria for ships, decisions can be made daily on which ships should dock first, which berth they should dock at, and when they should move and load. Simulations should model the decisions of human schedulers. Criteria can include cargo capacity of ships in port, length and cost of demurrage for each ship, which trades are being served by the ships, ship order priority, loading period, next open berth for loading, and ship and berth restrictions.

The development of an LNG spot market has resulted in the occurrence of short-term trades, with Australia to Spain deliveries being an example. These trades are inherently difficult to model, as they involve market prediction and economic optimization based on a number of constraints due to limited resources. A few criteria include economic impact of multiple liquefaction plants serving one trade, LNG price vs. trade distance (ship utilization) formulas, different pricing levels in different geographic areas, willingness of purchasers to pay premium prices for spot cargos, and contractual constraints.

In simulations of difficulties in ship scheduling, short-term scheduling problems, including routing and order scheduling, should be adequately modeled by the logic of the simulation program itself. Criteria for order scheduling include which terminal ordered first, which terminal needs the LNG more urgently, whether either terminal is behind on contractual deliveries, when the next ship arrives at the liquefaction plant, distances to receiving terminals, and price of LNG at each terminal.

The main point in outlining some of the decisions that the simulation logic must handle is not only to demonstrate the difficulty, but also show that the entire system must be treated as a whole, rather than as a group of unrelated pieces. The actions of one particular ship can be dependent on what each of the other ships and terminals are doing at any particular moment. Without taking these short-term scheduling problems and interactions into account, the long term averages of the simulation will not reflect real fleet operation. LNG shipping and storage systems are an important portion of the overall project economics. Optimizing the shipping and storage is critical to maximizing the return on the investment in the overall project. Creating a shipping model to simulate the system is an important tool for this optimization.

Simulation results can determine the level of LNG delivery as a function of number of ships, speed of ships, storage volume, number of berths, and many other variables. Sensitivity studies can determine the utility of an incremental increase in any of these variables. Extensive data gathered from the simulation may be used to analyze the system in detail to find delays in each portion of the system. The results and analyses can be used to design the optimal shipping and storage system.

Cost Reduction in LNG Export Terminals

Sophisticated shipping studies can reduce the total LNG storage volumes required, and thus reduce costs. Certain site specific cost savings can be achieved, for example by using air coolers instead of shell and tube sea water coolers. Other cost reduction areas can include: (i) use of higher capacity in-tank LNG ship loading pumps can enable the use of fewer pumps in the LNG storage tanks with resultant cost savings; (ii) optimization of acid gas removal by use of higher concentration solvent with reduced circulation rates e.g. activated MDEA; (iii) execution of Value Engineering Studies, which can involve a structured exercise including a brainstorming session followed by technical and economic evaluation of selected ideas; and/or (iv) careful selection of site location to avoid excessive site preparation, harbor development, dredging, jetty length, etc.

The installation of single or double containment LNG tanks compared with full containment tanks should be considered, where there is sufficient plot space and where necessary safety criteria are satisfied.

The use of aero-derivative gas turbine drives for refrigeration compressors, e.g., a GE LM6000, has possibilities for cost reduction. These machines are generally lighter and smaller than industrial gas turbines, but are more expensive. Higher efficiency and improved reliability can result in reduced life cycle costs under certain conditions. With increased efficiency there is a reduction in fuel gas demand that may require some innovative thinking in the development of the overall fuel gas balance for the LNG plant.

The use of modularization can transfer site construction work to fabrication workshops. Improved productivity can reduce labor costs; however, additional costs are typically incurred due to the increase in steelwork necessary for transportation of the modules. In the extreme, the LNG plant could be erected on a purpose built concrete or steel barge which could be towed to the site and floated into a prepared dock, settled down by ballasting and filled in to form a permanent foundation. The main advantage of modularization and barge-mounted facilities is the reduction in site work and site labor, which is particularly important in harsh environments such as northern Norway, Sakhalin Island and Alaska.

Design practices and engineering specifications can impact every aspect of the plant, and thus represent an opportunity for significant cost savings. Cost saving exercises often focus on equipment because the potential cost savings in equipment are relatively easy to identify. The cost savings related to bulk materials could also be important. Within the process trains the bulk materials have a cost similar to the equipment. No single item is likely to save a large percentage of costs, but taken together many small savings can add up to a sizable total.

Any means of reducing schedule generally has a corresponding cost benefit. Interest on capital is reduced and cash flow for the project is improved by earlier sales of LNG. A number of suggestions have been made for reducing schedule such as: optimization of contract strategy, early placement of long lead items, optimum site selection, and utilizing an integrated project team.

Natural Gas Specification

Natural gas contains methane, heavier hydrocarbons, and inert components which all can effect burner performance. For this reason, pipeline companies and LNG buyers specify allowable ranges of components and heating values. These requirements can vary widely depending on the market location. Historically, plant designs have been based on long term contracts to a limited number of buyers at defined gas specifications, and there was little need for flexibility in the plant designs, either on the liquefaction or receiving ends of the trade. However, the situation is changing as LNG trade becomes more global. The owners of liquefaction plants can now target more than one market, and new markets may have gas specification requirements that are not always compatible with existing trades. Furthermore the growing spot market for LNG provides opportunities for buyers and sellers who have the ability to be flexible on product specifications. As a result there is now a desire for technical solutions regarding conditioning of LNG, such as the ability to modify the heating value of a product stream at a liquefaction facility.

To prevent liquid dropout, natural gas pipeline companies generally limit the amount of butane, pentane and heavier components that can be in a product. LNG plants must remove heavier hydrocarbon components to prevent freezing in the liquefaction process, and the heavies removed typically become a natural gasoline by-product stream. The requirements for heating value and gas interchangeability can vary depending on the geographic location of the particular market. LNG products from worldwide sources can also vary significantly in composition and heating value.

Early LNG trade was primarily to Japan from Pacific Rim and Middle East export plants and to Europe from Northern Africa plants. The Japanese specifications can vary depending on the importing utility company, but typically have a high heating value between 39.7 and 43.3 MJ/Sm$^3$ (Megajoules per Standard meter cubed at 1 atm and 15° C., which converts to 1065 to 1160 Btu/SCF for a standard cubic foot at 14.73 psia and 60° F.). This relatively high range permits maximum use of infrastructure by moving greater combustion heat capacity for a given volume. European countries typically allow wider ranges. Spain, for example, allows a range between 35.0 and 44.9 MJ/Sm$^3$ (940 and 1205 Btu/SCF).

In one example a gas with HHV=42.6 MJ/Sm$^3$ is suitable for the Japanese and Korean markets, but is too high for the US or UK markets. In the second example a gas with HHV=37.2 MJ/Sm$^3$ meets US/UK specifications but has a HHV too low for Korea or Japan markets. Both examples however are within the ranges allowed for France and Spain.

Modifying heating value at the liquefaction end usually means adding or extracting ethane, propane and butane (LPG), though nitrogen may also play a part. For natural gas supplies rich in LPG components such as in the Atlantic Basin, a lower high heating value (HHV) is preferred if the US and UK markets are to be the consumers. On the other hand, Pacific Rim consumers prefer a gas with increased HHV, and Pacific Rim sources that are lean in LPG components may require upward HHV adjustment. Natural gas sourced in the Middle East can physically be shipped to either the Pacific or Atlantic markets, which raises the possibility of producing two product qualities of differing heating values.

If LPG must be purchased and injected at the liquefaction location the first challenge is finding a local source with sufficient quality and then installing the facilities for unloading and storage. More refrigeration is required because the LPG must be chilled from −40° C. (in the case of propane) down to −160° C. This requires energy which can be applied as additional boil off gas compression or refrigeration compression. If the LPG is injected at −40° C. into the LNG then the LPG chilling is accomplished by vaporizing methane, which can lead to cavitation within the piping at or near where the injection occurs if the injection is done within the process. If the addition is make in the storage vessels, vaporized methane increases the boil off gas that must be compressed to high enough pressure to be used as fuel or feed to the natural gas section of the liquefaction process.

Simply injecting −40° C. LPG into the LNG is equivalent to pure component refrigeration with methane at −160° C. in a single stage, which is not very efficient. A better approach is to stage the injection into liquid methane at several pressure levels, or use refrigeration to chill the LPG to temperatures closer to LNG temperatures prior to injection. This can be accomplished by adding an LPG injection pass to the MCHE, or adding another exchanger in parallel to the MCHE, using liquefaction level refrigerant to provide the necessary cooling duty.

At some facilities there may be a desire to market multiple products, such as a high HHV product and a low HHV product. For a liquefaction plant with a lean feed gas this may be accomplished by importing LPG and injecting the LPG on a cargo by cargo basis. The LPG injection equipment may be utilized for a cargo destined for a high HHV market, but may remain idle when loading a ship headed for a low HHV market. In theory it is possible to chill the LPG prior to injection using liquefaction refrigeration as mentioned above, but every loading may significantly change operations within the train. For this reason it may be more efficient to have a stand-alone refrigeration unit, or to rely on greater boil off gas compressor capacity.

An important technical feature of the design is to avoid sudden vaporization of the LNG as the LPG is injected. This can be achieved by pumping the LNG to higher pressure before using the LNG to chill the LPG.

If the opposite situation exists where a plant with significant LPG in the feed is considered for both low and high HHV markets, the LPG can be extracted and stored or exported until a high HHV cargo is needed.

One way to accommodate multiple products is based on a large facility where two separate products can be produced in different trains with the two products stored separately. This becomes more convenient if two berths are also present, each with their own loading lines. The disadvantage of this method is the extra storage capacity that would have to be installed compared to a single product facility.

A plant producing multiple products will cost more than a plant marketing a single product. The multiple product plant may still be competitive if the plant is closer to the consumer or has economy of scale advantages over single product plants in the same market.

Figure 19:
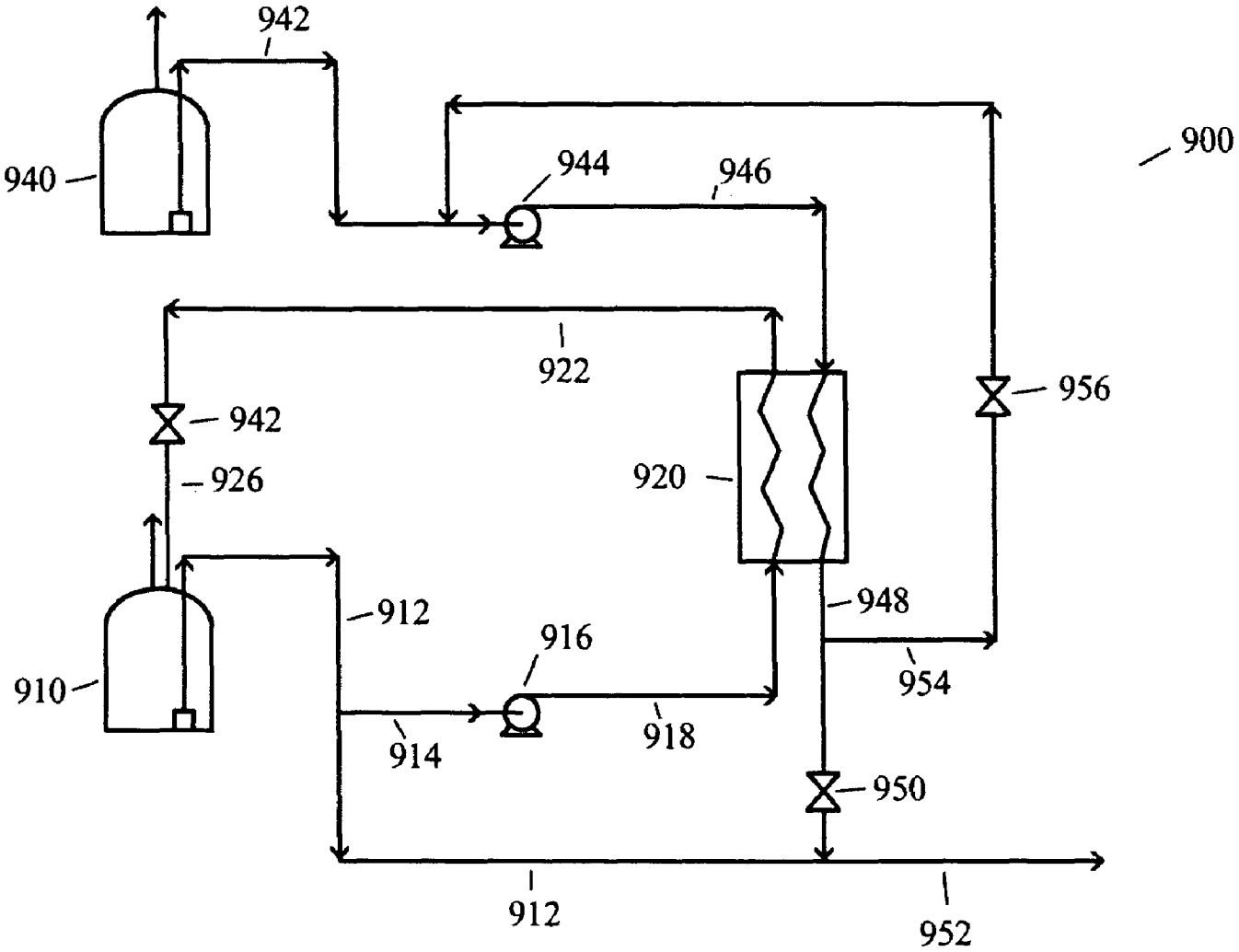
FIG. 19 depicts a schematic illustration of an embodiment of the present invention wherein a cooled stream of LPG is added to an LNG stream to increase the heating value.

FIG. 19 depicts a schematic illustration of an embodiment of the present invention wherein a cooled stream of LPG is added to an LNG stream to increase the heating value. In FIG. 19, an embodiment is depicted wherein a cooled stream of LPG is added to an LNG stream to increase the heating value. LNG is used as a cold energy source and is pressurized so that the LNG that is warmed remains in a liquid state. In process 900, the LNG is stored in a storage vessel 910. LNG is pumped out of the storage vessel 910 into line 912 and can be delivered for loading onto a transport vessel (not shown). A side stream 914 can be further compressed in pump 916 to form a higher pressure LNG stream 918 that flows through one or more heat exchangers 920 to transfer cold energy to the other stream. The warmed LNG exits heat exchanger 920 via line 922, and then flows through a liquid expander 924 to chill and reduce the pressure in line 926 prior to returning to the LNG storage vessel 910. The pump 916 raises the LNG to a level to ensure that the LNG remains in liquid state after the warming that occurs in the heat exchanger 920.

LPG is stored in a storage vessel 940. LPG is pumped out of the storage vessel 940 into line 942 and can be further compressed in pump 944 to form a higher pressure LPG stream 946 that enters the heat exchanger 920 to be cooled by cross-exchange with the LNG of line 918. The cooled LPG exits the exchanger 920 in line 948 and can flow through control valve 950 prior to blending with the LNG stream 912 to form an LNG stream 952 having a higher heating value than the LNG prior to blending.

A portion of the chilled LPG 948 can be diverted to a side stream 954 that can be controlled by valve 956 and returned into line 942. This recycle loop of line 954 can be used to reduce the temperature of the LPG flows 946, 948 to tighten the temperature approach of exchanger 920 and chill the LPG being added into the LNG to reduce flashing or cavitation upon mixing of the higher temperature LPG into the lower temperature LNG.

In one embodiment, the LNG can be stored at a temperature of about −160° C. and the LPG can be stored at about −40° C. The LNG 918 can enter the exchanger 920 at about −160° C. and exit the exchanger 920 at a warmer temperature, for example, between −140° C. to about −100° C. The warmed LNG 922 is then expanded and cooled in the liquid expander 924 prior to reentering the LNG storage 910. The LPG can be stored at a temperature of about −40° C. The LPG 942 will be at about −40° C. prior to mixing with the chilled LPG from line 954. The chilled LPG from line 948 can achieve temperatures approaching the LNG inlet temperature in line 918, for example between −120° C. to about −160° C. The mixed LPG stream 946 can have a temperature within the range of between −40° C. to −160° C. depending on the ratio of flows in lines 942 and 954, generally the mixed LPG stream 946 will have a temperature within the range of about −80° C. to about −120° C.

The cold approach temperature between the cold LNG stream 918 entering the exchanger 920 and the cold LPG stream exiting 948 is desirably less than 50° C. In alternate embodiments the cold approach temperature is less than 35° C., less than 25° C., less than 15° C., less than 10° C., or less than 5° C.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, the term should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method of altering the heating value of a liquefied natural gas stream comprising:

providing a first liquefied hydrocarbon composed of at least 90 wt % methane, having a temperature of about −150° C. or less and having a first heating value, in a first storage vessel;

providing a second liquefied hydrocarbon composed primarily of one or more of ethane, propane, and butane, or mixtures thereof;

providing a first stream of the first liquefied hydrocarbon from the first storage vessel;

diverting a first portion of the first stream and compressing it to form a compressed first stream;

passing the compressed first stream through the cold side of a first heat exchanger to obtain a heated first stream;

decompressing the heated first stream in a first liquid expander to obtain a decompressed first stream;

returning the decompressed first stream back to the first storage vessel;

providing a second stream of the second liquefied hydrocarbon;

compressing the second stream to form a compressed second stream having a temperature from about −40° C. to about −160° C.;

passing the compressed second stream having a temperature from about −40° C. to about −160° C. through the warm side of the first heat exchanger to cool the compressed second stream to obtain a cooled second stream;

combining a first portion of the cooled second stream with a second portion of the first stream to obtain an third stream having a second heating value greater than the first heating value of the first liquefied hydrocarbon.

2. The method of claim 1, wherein the first liquid expander provides static expansion to the heated first stream to obtain the decompressed first stream.

3. The method of claim 1, further comprising:

diverting a second portion of the cooled second stream and decompressing it in a second liquid expander to form a second decompressed second stream; and injecting the second decompressed second stream into the second stream.

4. The method of claim 3, wherein the second liquid expander provides static expansion to a portion of the cooled second stream to obtain the second decompressed second stream.

5. The method of claim 1, wherein the flow of the cooled second stream into the first stream is regulated to control the heating value of the third stream.

6. The method of claim 1, wherein the temperature of the cooled second stream is no more than 50° C. warmer than the temperature of the first stream.

7. The method of claim 1, wherein the high heating value of the third stream is 1050 Btu/SCF or greater.

8. The method of claim 1, wherein the pressure of the heated first stream is sufficient to keep the heated first stream in a liquid state.

9. The method of claim 1, wherein the temperature of the heated first stream is no warmer than −100° C.

10. The method of claim 1, wherein the temperature of the cooled second stream is cold enough to prevent cavitation as the cooled second stream is combined with the first stream.

11. The method of claim 1, wherein temperature approach on the heat exchanger between the heated first stream and the compressed second stream is less than 20° C.

12. The method of claim 1, wherein temperature approach on the first heat exchanger between the compressed first stream and the cooled second stream is less than 20° C.

13. The method of claim 1, further comprising:

diverting a second portion of the cooled second stream and decompressing it in a second liquid expander to form a second decompressed second stream, wherein flow of the second decompressed second stream is regulated to maintain a temperature approach on the first heat exchanger between the heated first stream and the compressed second stream of less than 20° C.

14. The method of claim 1, further comprising:

diverting a second portion of the cooled second stream and decompressing it in a second grid expander to form a second decompressed second stream, wherein flow of the ninth stream is regulated to maintain a temperature approach on the first heat exchanger between the compressed first stream and the cooled second stream at no more than 20° C.

15. The method of claim 1, wherein the temperature of the second stream is 0° C. or less.

16. The method of claim 1, wherein the temperature of the second stream is −30° C. or less.

17. A method of modifying the heating value of a liquefied natural gas stream comprising:

providing LNG composed of at least 90 wt % methane, and having a first heating value in a first storage vessel;

providing LPG composed primarily of one or more of ethane, propane, and butane, or mixtures thereof;

passing a first stream of the LNG through a first heat exchanger to provide cooling energy and a warmed first stream of the LNG;

passing a stream of the LPG having a temperature from about −40° C. to about −160° C. through the first heat exchanger to obtain a cooled stream of the LPG;

providing a second stream of the LNG;

blending a first portion of the cooled stream of the LPG with the second stream of the LNG to obtain a third stream containing LNG and containing increased content of LPG and thus having a heating value greater than the first heating value of the LNG.

18. The method of claim 17, further comprising returning the warmed first stream of the LNG exiting the first heat exchanger to the first storage vessel.

19. The method of claim 17, wherein the temperature of the cooled stream of the LPG exiting the first heat exchanger is no more than 50° C. warmer than the temperature of the first stream of the LNG entering the first heat exchanger.

20. The method of claim 17, further comprising blending a second portion of the cooled stream of the LPG exiting the first heat exchanger into the stream of the LPG prior to entering the first heat exchanger.

21. The method of claim 1, wherein the compressed second stream, has a temperature from about −80° C. to about −120° C.

22. The method of claim 17, wherein the stream of the LPG has a temperature from about −80° C. to about −120° C.

* * * * *